US007877954B1

(12) United States Patent
Saebi

(10) Patent No.: US 7,877,954 B1
(45) Date of Patent: Feb. 1, 2011

(54) COMPOSITE BUILDINGS AND METHODS OF CONSTRUCTING COMPOSITE BUILDINGS

(76) Inventor: Nasser Saebi, 18231 N. 66th La., Glendale, AZ (US) 85308

( * ) Notice: Subject to any disclaimer, the term of this patent is extended or adjusted under 35 U.S.C. 154(b) by 0 days.

(21) Appl. No.: 12/322,750

(22) Filed: Feb. 5, 2009

Related U.S. Application Data

(60) Provisional application No. 61/063,771, filed on Feb. 6, 2008.

(51) Int. Cl.
*E04B 1/00* (2006.01)

(52) U.S. Cl. ..... 52/745.2; 52/309.1; 52/309.3

(58) Field of Classification Search ..... 52/34, 52/304.12, 309.17, 741.41, 747.1, 79.14, 52/309.1, 309.3, 730.4, 732.1, 762, 763, 52/729.2, 726.1–726.5
See application file for complete search history.

(56) References Cited

U.S. PATENT DOCUMENTS 3,861,093 A * 1/1975 Robinson ..... 52/79.14
4,774,794 A * 10/1988 Grieb ..... 52/309.7
5,771,649 A * 6/1998 Zweig ..... 52/405.1
6,006,480 A * 12/1999 Rook ..... 52/309.12
6,182,409 B1 * 2/2001 Visser ..... 52/309.13
6,185,891 B1 * 2/2001 Moore ..... 52/309.7
6,721,684 B1 * 4/2004 Saebi ..... 702/183
6,898,908 B2 * 5/2005 Messenger et al. ..... 52/268
6,912,488 B1 * 6/2005 Saebi ..... 703/1
2002/0106503 A1 * 8/2002 Monk et al. ..... 428/314.4
2003/0079438 A1 * 5/2003 Stephens et al. ..... 52/782.1
2003/0089061 A1 * 5/2003 DeFord et al. ..... 52/309.9
2004/0065034 A1 * 4/2004 Messenger et al. ..... 52/309.11
2005/0074593 A1 * 4/2005 Day et al. ..... 428/292.1
2005/0170120 A1 * 8/2005 Teitelbaum et al. ..... 428/36.91
2008/0047217 A1 * 2/2008 Browning et al. ..... 52/588.1
2008/0292854 A1 * 11/2008 Miller et al. ..... 428/219

* cited by examiner

*Primary Examiner*—Richard E Chilcot, Jr.
*Assistant Examiner*—Mark R Wendell
(74) *Attorney, Agent, or Firm*—Albert W Davis, Jr.

(57) ABSTRACT

The invention contemplates constructing a building by making composite walls in a factory using continuous or batch processing equipment. To make the walls, a Fiber Reinforced Coating (FRC) is prepared and then applied to foam core panels on their faces. Preferably, the panels are precut to the required dimensions before coating with openings for doors and windows. The coated panels are then transported to the site and bonded together to form the building.

3 Claims, 42 Drawing Sheets

COMPOSITE BUILDINGS AND METHODS OF CONSTRUCTING COMPOSITE BUILDINGS

CROSS-REFERENCE TO RELATED APPLICATIONS

This application is a non-provisional application of provisional patent application Ser. No. 61/063,771, filed Feb. 6, 2008 to Nasser Saebi for Composite Buildings And Methods Of Constructing Composite Buildings.

The following references are incorporated by reference: U.S. Pat. No. 6,308,490 issued Oct. 30, 2001 and U.S. Pat. No. 6,912,488 issued Jun. 28, 2005 to Nasser Saebi for Method of Constructing Curved Structures as Part of a Habitable Building, U.S. Pat. No. 6,721,684 issued Apr. 13, 2004 and U.S. Pat. No. 6,985,832 issued Jan. 10, 2006 to Nasser Saebi for Method of Manufacturing and Analyzing a Composite Building.

BACKGROUND OF THE INVENTION

This invention relates to the construction of buildings by using predominantly a composite material. The composite material is a plastic foam core with a Fiber Reinforced Coating (FRC) applied to each major surface or face of the plastic core.

BRIEF SUMMARY OF THE INVENTION

This invention has been verified by a Finite Element Analysis (FEA). The inventor's U.S. Pat. No. 6,721,684 teaches how to perform the FEA.

Composite buildings can be constructed at the building site by erecting foam walls and then coating the walls with a Fiber Reinforced Coating (FRC). That method requires the walls to be coated in a vertical orientation which requires crews of coating professionals be available at the site.

This invention addresses that and other issues. In the inventive method, the walls are coated in a factory and then transported to the building site. At the site, the walls are taken off the truck by a crane, positioned in place and bonded to the footings and/or slab (concrete or composite, such as GFRC coated plastic foam) of the building.

By coating the foam wall in a factory, the walls can be laid out horizontally and coated. Coating the walls in a horizontal position (lying flat) is much easier than in a vertical orientation. Further, the coating crew can work on other buildings without going to another site.

The factory, coated walls can be considered to be composite "lumber". The composite lumber can be cut by saws (diamond blade) to form openings for windows and doors. The composite pieces from the windows and doors can be used to provide trim pieces, parapet walls, etc. The walls can be structurally joined/connected with a structural bonding agent, such as a FRC, such as Glass Fiber Reinforced Concrete (GFRC).

This method allows the composite building to be constructed by carpenters and other tradesmen who are already trained in building construction. Thus, a new type of building which is "green" and "sustainable" can be introduced to the building industry while using the current skills of the tradesmen.

As an example, the lumber can be 60 feet long by 10 feet wide, that is, the permissible size for transport. The lumber can be sawn into the desired dimensions and bonded or otherwise joined together.

DETAILED DESCRIPTION OF THE INVENTION

The invention contemplates making walls in a factory using continuous or batch processing equipment. The Fiber Reinforced Coating (FRC) is prepared and then applied to the foam core panels. Preferably, the panels are precut to the required dimensions before coating with openings for doors and windows. Alternatively, the openings and shape of the wall can be cut after the coating has somewhat or fully cured.

The invention provides a unique method of coating the foam panels to form the composite. A batch cement mixer can be used to provide the GFRC (Glass Fiber Reinforced Concrete) material for the coating.

The GFRC contains a polymer that sticks to most surfaces. To solve this problem, the parts of the mixer that contact the GFRC can be coated with a nonstick material, such as polytetraflourethylene (PTFE), also sold as TEFLON™. All of the equipment handling the FRC can be made of a material that does not stick to the polymer in the FRC. That is the equipment parts that contact the FRC, such as Glass Fiber Reinforced Concrete (GFRC), can be made of a nonstick material or can be coated with a nonstick material.

The GFRC can be fed by a chute to the foam panel which can be laid on the ground or other surface. If the surface is cement, it can be covered by a plastic sheeting to catch any GFRC that does not stay on the foam panel. The chute is moved along the foam panel or panels. The GFRC coating is spread by a roller that can be coated with a nonstick material.

Alternatively, the foam can be placed on a conveyor that is moved under the chute which deposits the GFRC on the foam. A suitable mixing system can be provided by the Cemen Tech Company, USA.

After the spreading step, there is a finishing step in which a trowel-like tool is used. The finishing step provides a smoother surface. The trowel-like tool can have a nonstick coating.

The coated foam is allowed to set, at least partially. Then, the foam panel with one side coated with GFRC is turned over and the other side coated with GFRC.

The composite panels made by this process can be cut into the appropriate length to form a wall or other size pieces.

The walls can have the windows, doors and other openings precut in the foam. The openings can then be filled with pieces of foam or other "dummies" that can be removed after the coating step, thereby leaving the hole.

Alternatively, the coating and foam can be cut at anytime, before or after the GFRC coating has fully set.

The coated panels can be cut to desired size, like lumber. A diamond blade saw is needed if the coating as hardened.

The coating thickness which can be a 0.25 inch of GFRC can be measured by a laser or a screed or guide can be used to achieve the thickness.

Figure 1:
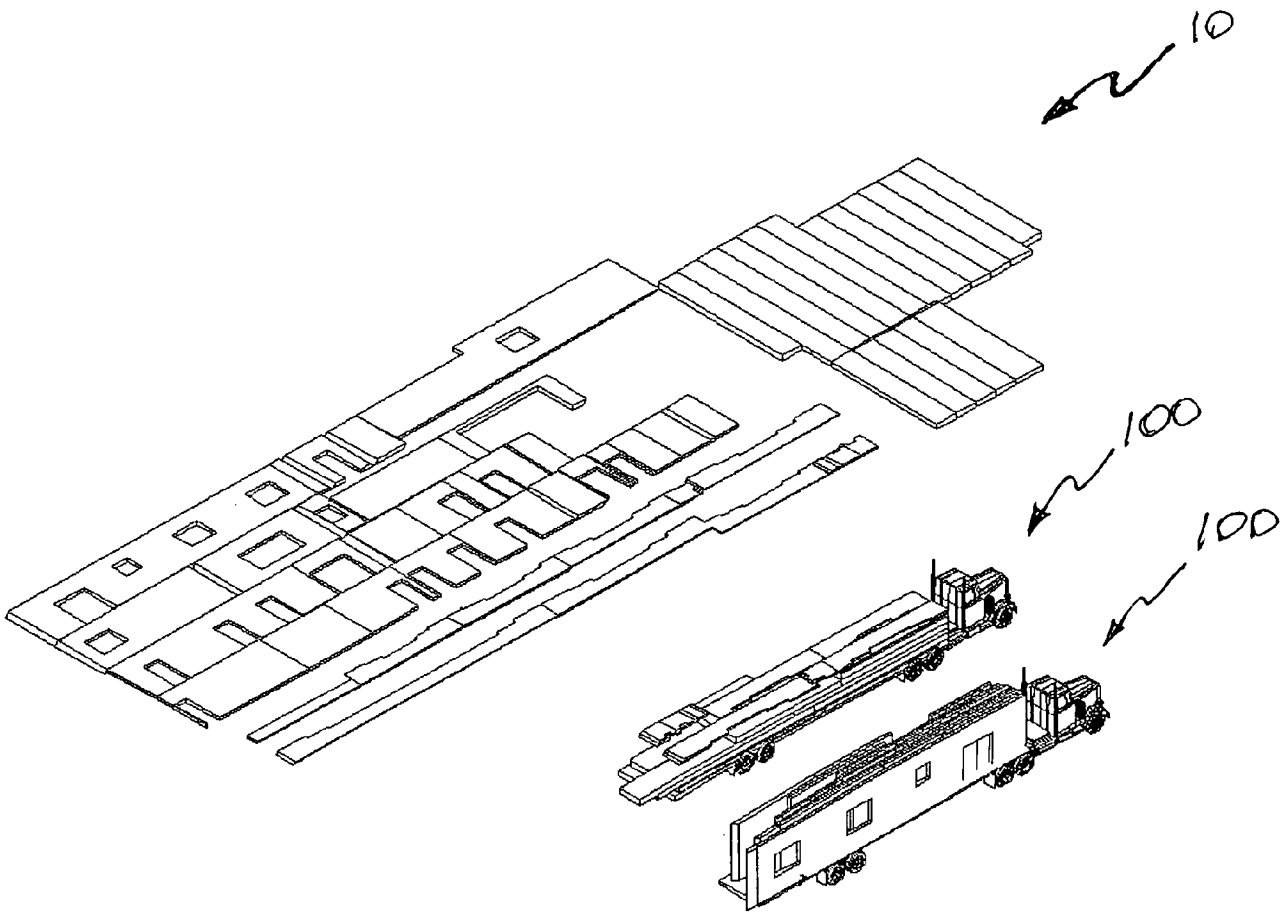
FIGS. 1-40 show perspective views of the invention.

FIG. 1 shows the pieces 10 of the building which have been prepared in a factory or place other than the building site. The pieces can be made of 8 inch thick Expanded PolyStyrene (EPS) foam with a ¼-⅜ inch coating of GFRC on each major side/face. In this case, the spaces/openings for the windows and the doors have been created in the walls. Windows and doors can be provided at the factory. Alternatively, the openings can be created at the site.

The lower portion of the figure shows the pieces loaded on two trucks 100 for transport to the building site. The pieces can be loaded on to the trucks by a crane or hand. The crane can load the longer pieces by using two straps on the piece.

Figure 2:
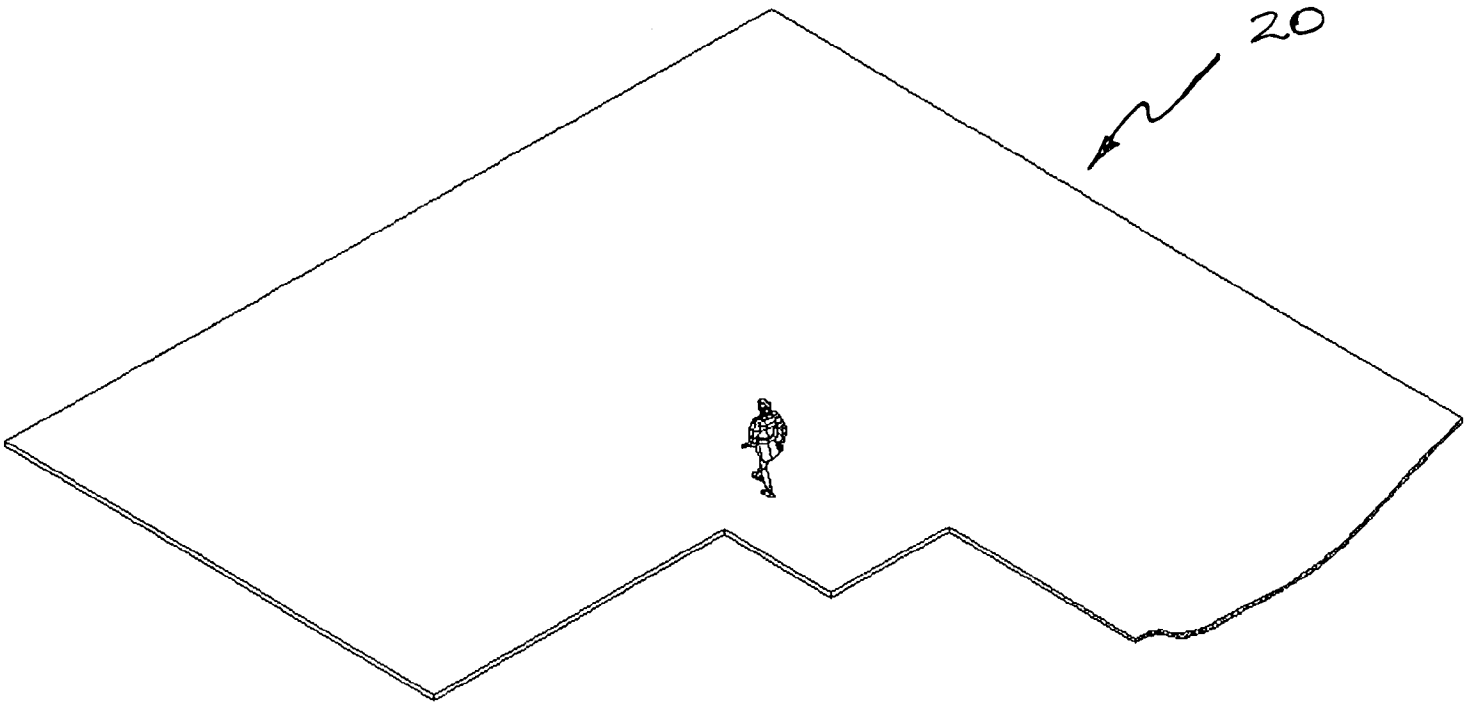

FIG. 2 shows the building site with a concrete slab 20.

Figure 3:
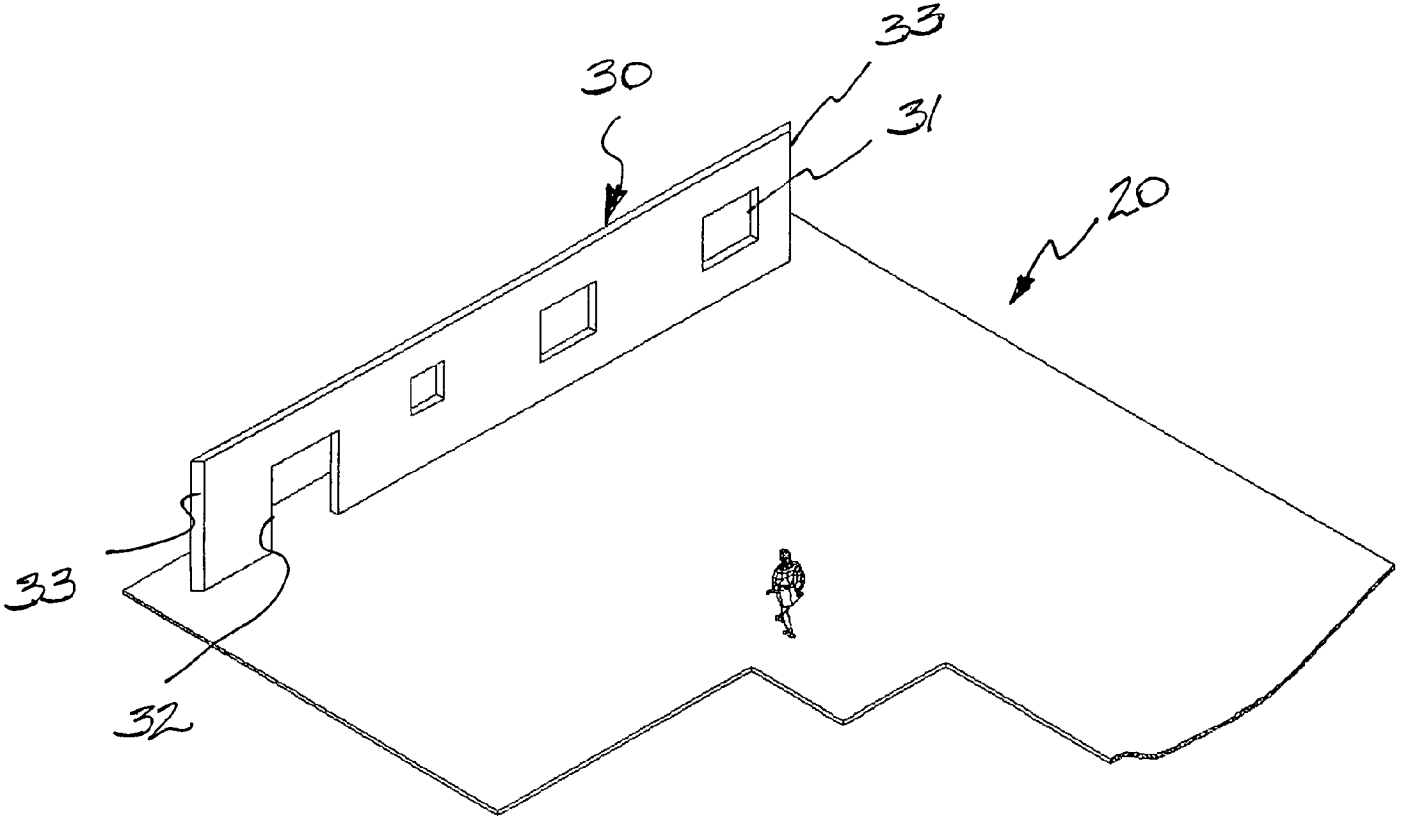

FIG. 3 shows slab 20 with the first wall 30 set in place on the slab. The wall 30 has window openings 31, door opening 32 and mitered/slanted side edges 33. The wall 30 is connected to the slab by a bonding agent, such as a Fiber Reinforced Coating (FRC) such as Glass Fiber Reinforced Concrete (GFRC), between the bottom edge and the slab. The wall is set in place with a bonding agent between the foam bottom edge and the slab and is held up by shoring.

Figure 4:
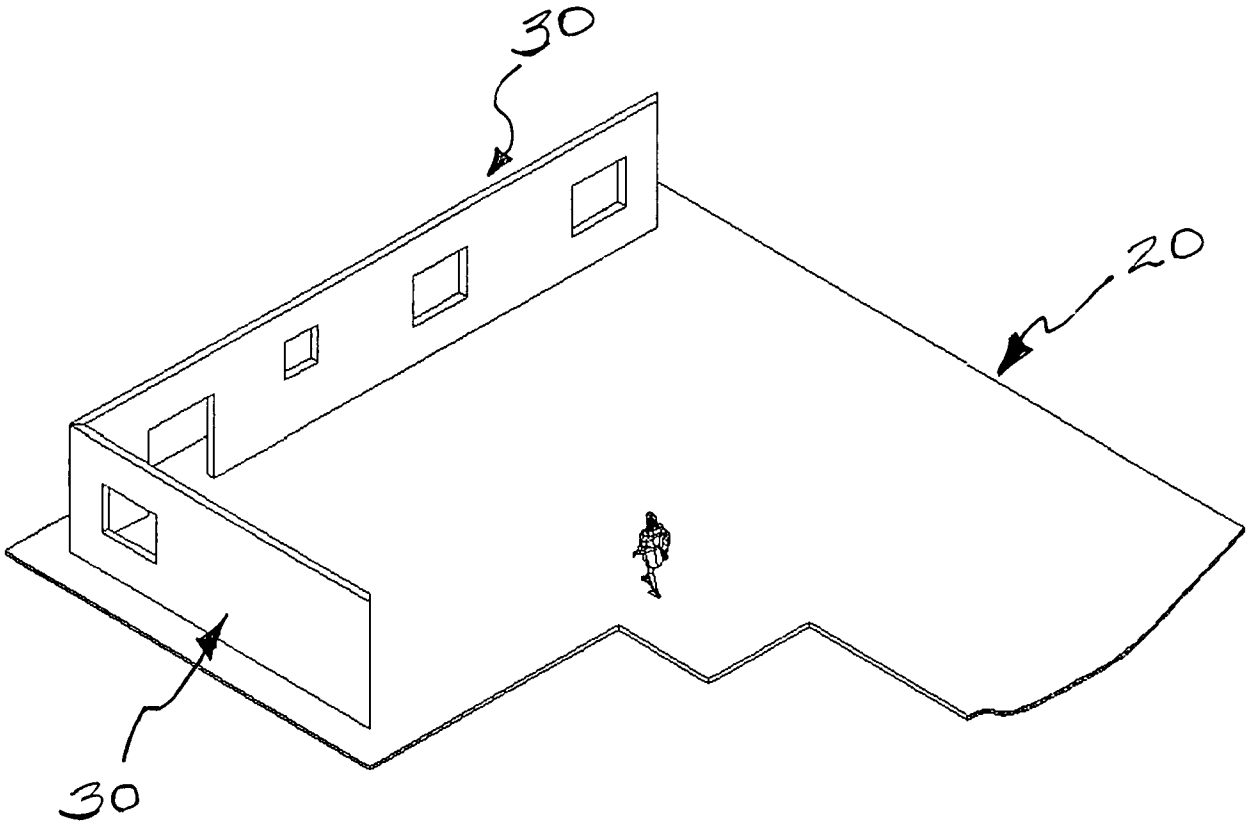
Figure 5:
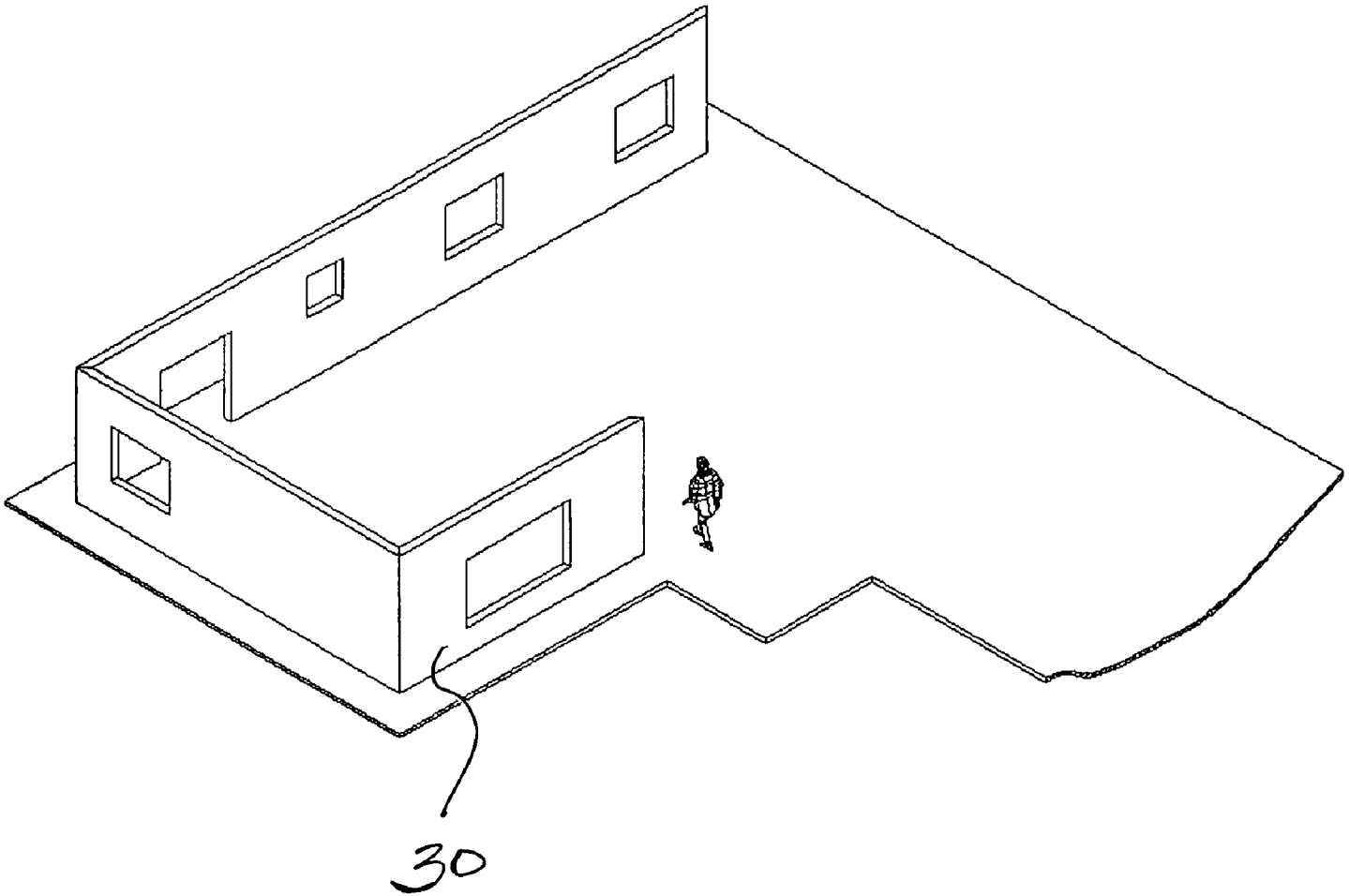
Figure 6:
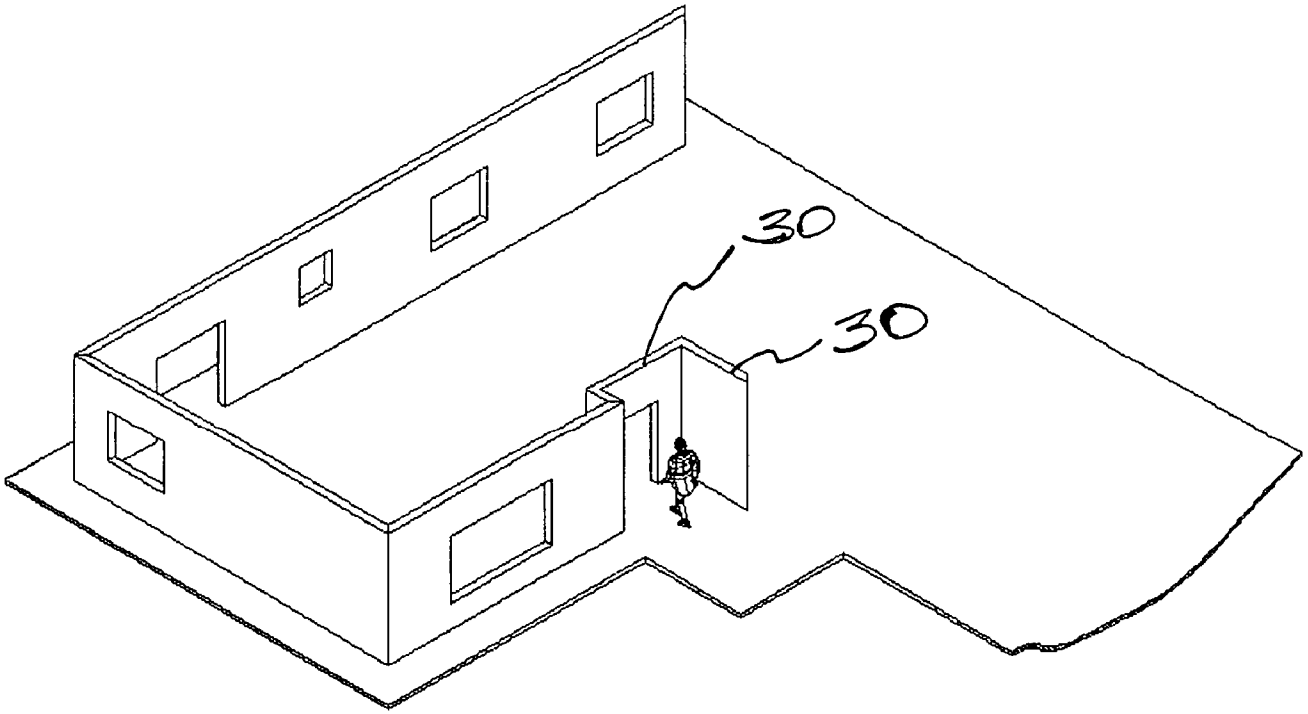
Figure 7:
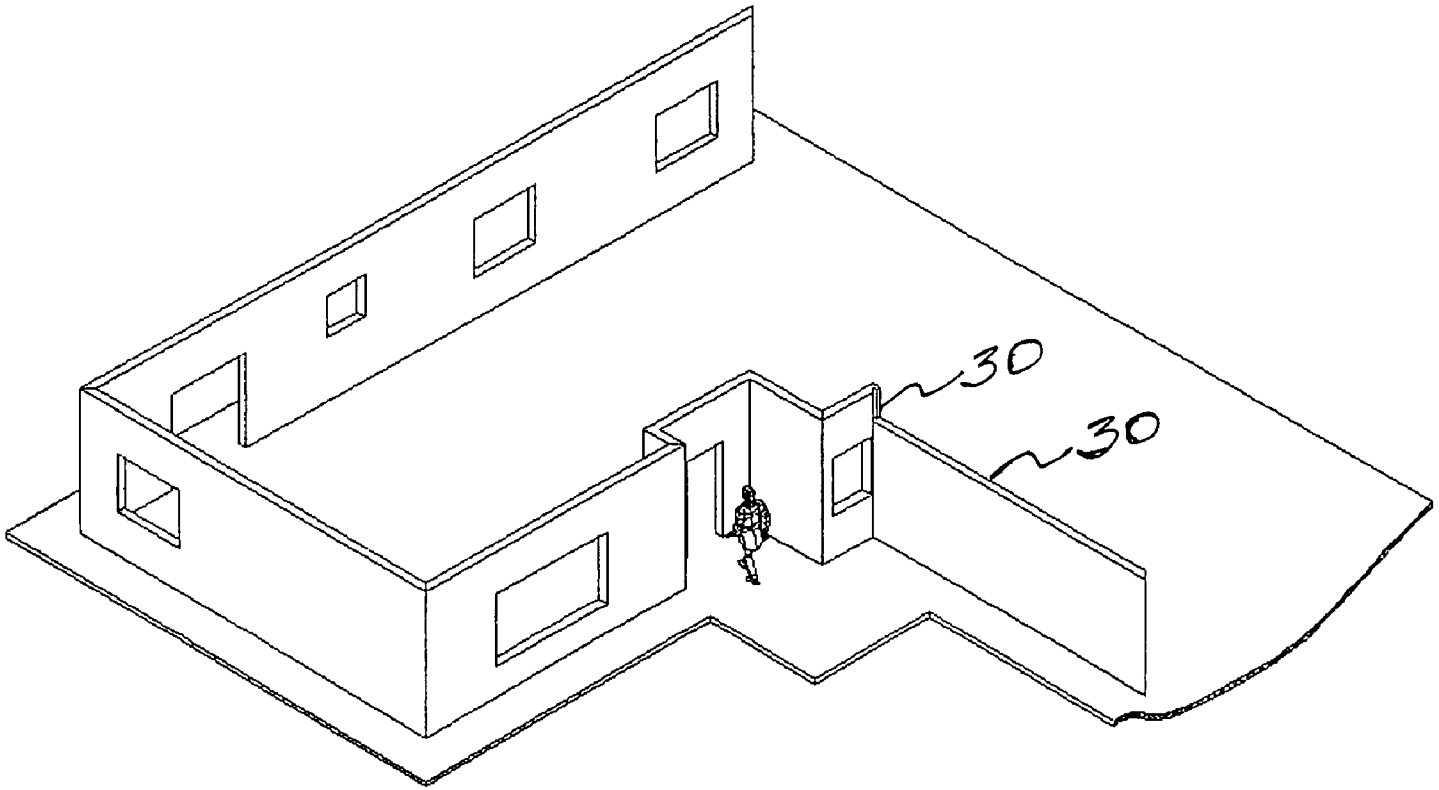

FIG. 4 shows a second wall 30 set in place, bonded to the slab 20 and bonded to the first wall along the side edge with GFRC. The second wall 30 has mitered side edges which match with the first wall to form a mitered joint at the corner. Some walls can have only one mitered edge. The other edge can be perpendicular to the wall.

Figure 8:
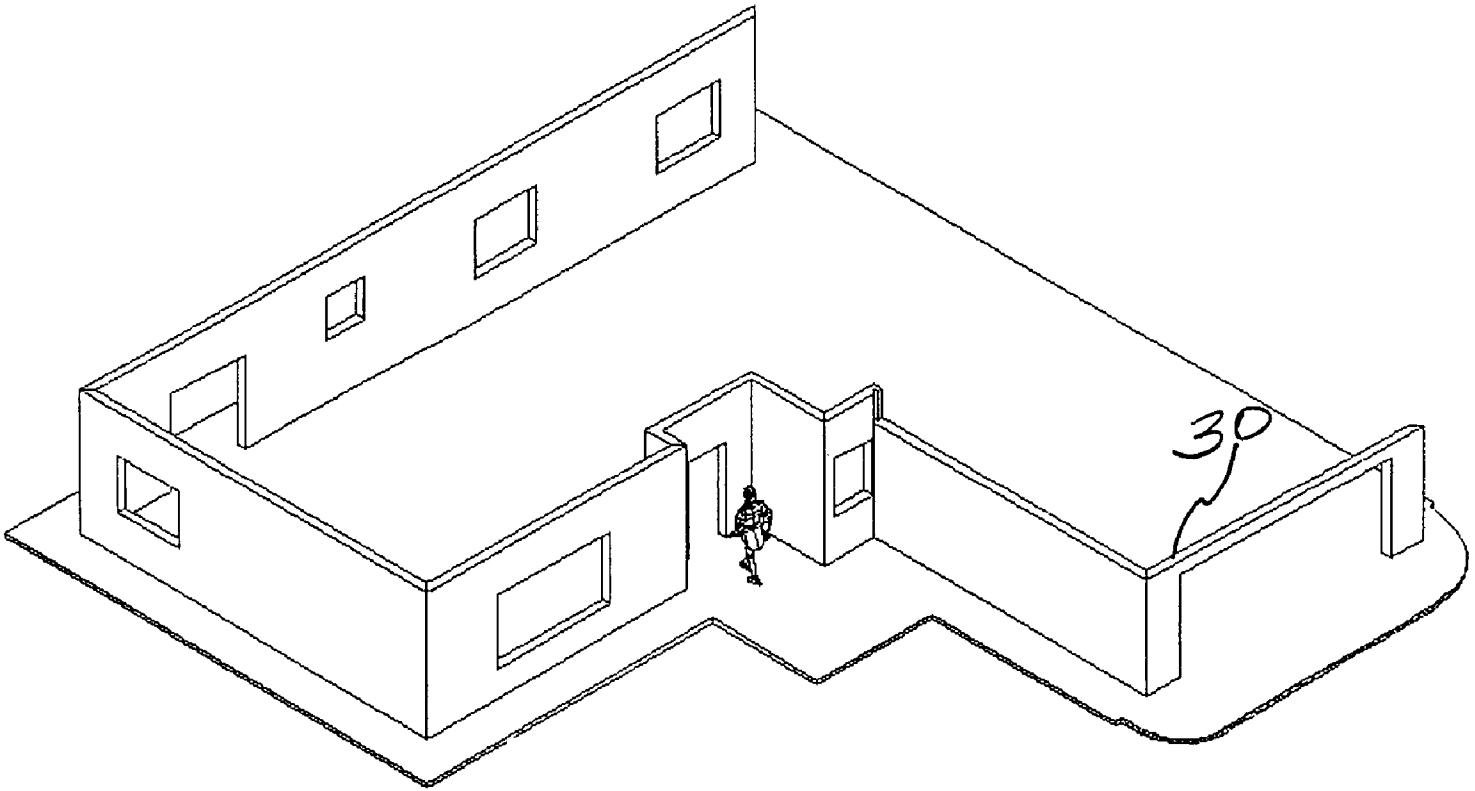

FIGS. 5-8 show the addition of more outer walls 30. In FIG. 8, the front wall 30 of the garage has been added, but it can be added later as shown in the FIG. 13.

Figure 9:
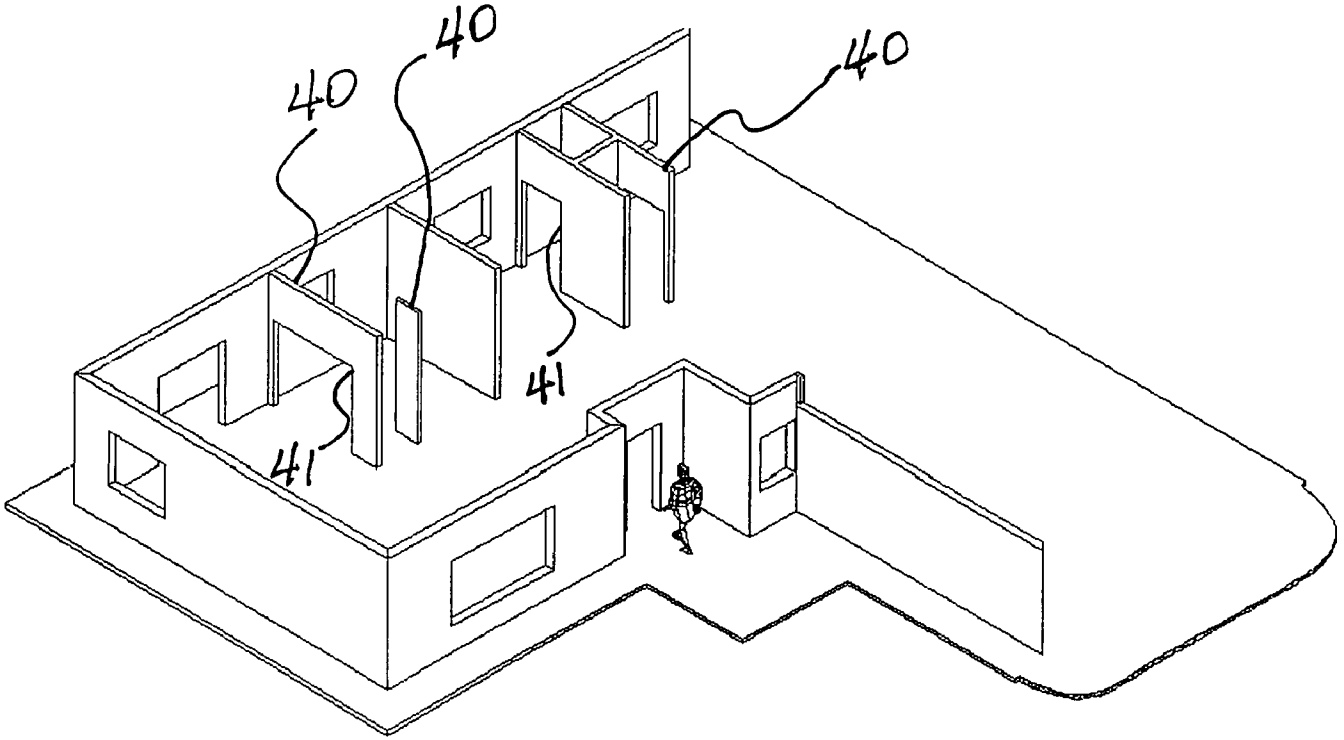
Figure 10:
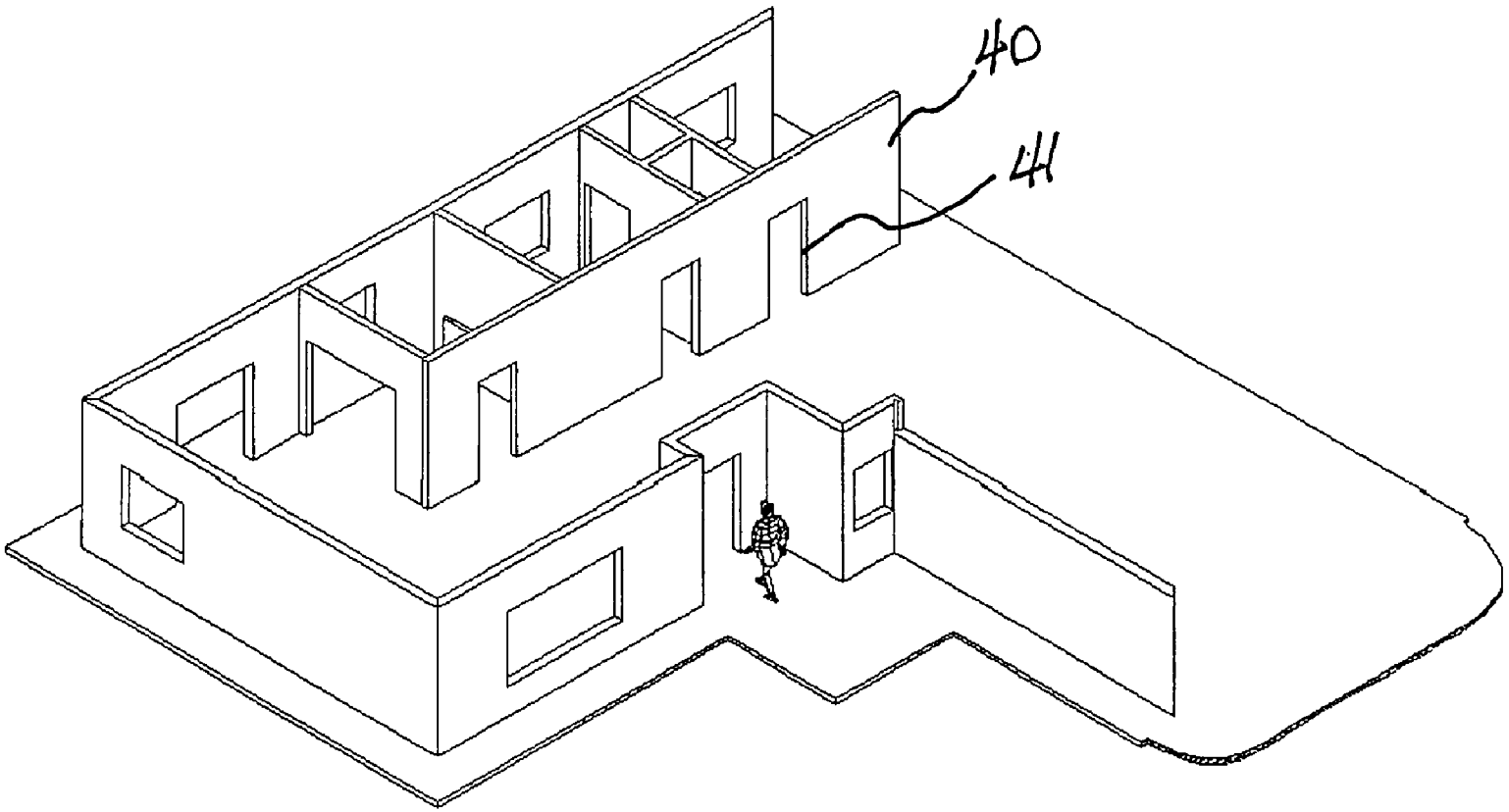
Figure 11:
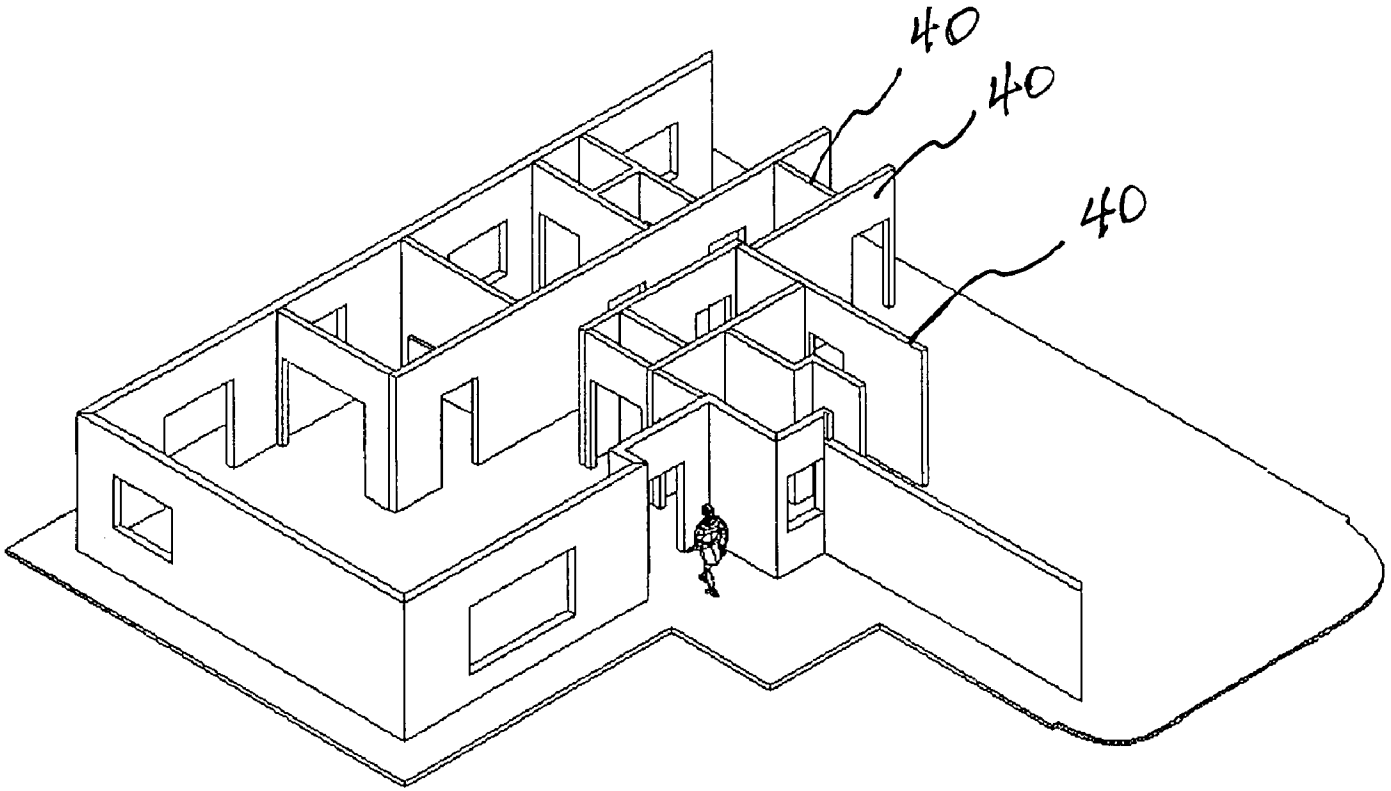

FIGS. 9-11 show the addition of inner walls 40 with openings 41. The walls 40 are bonded to the slab along their bottom edges and to other walls along their side edges.

Figure 12:
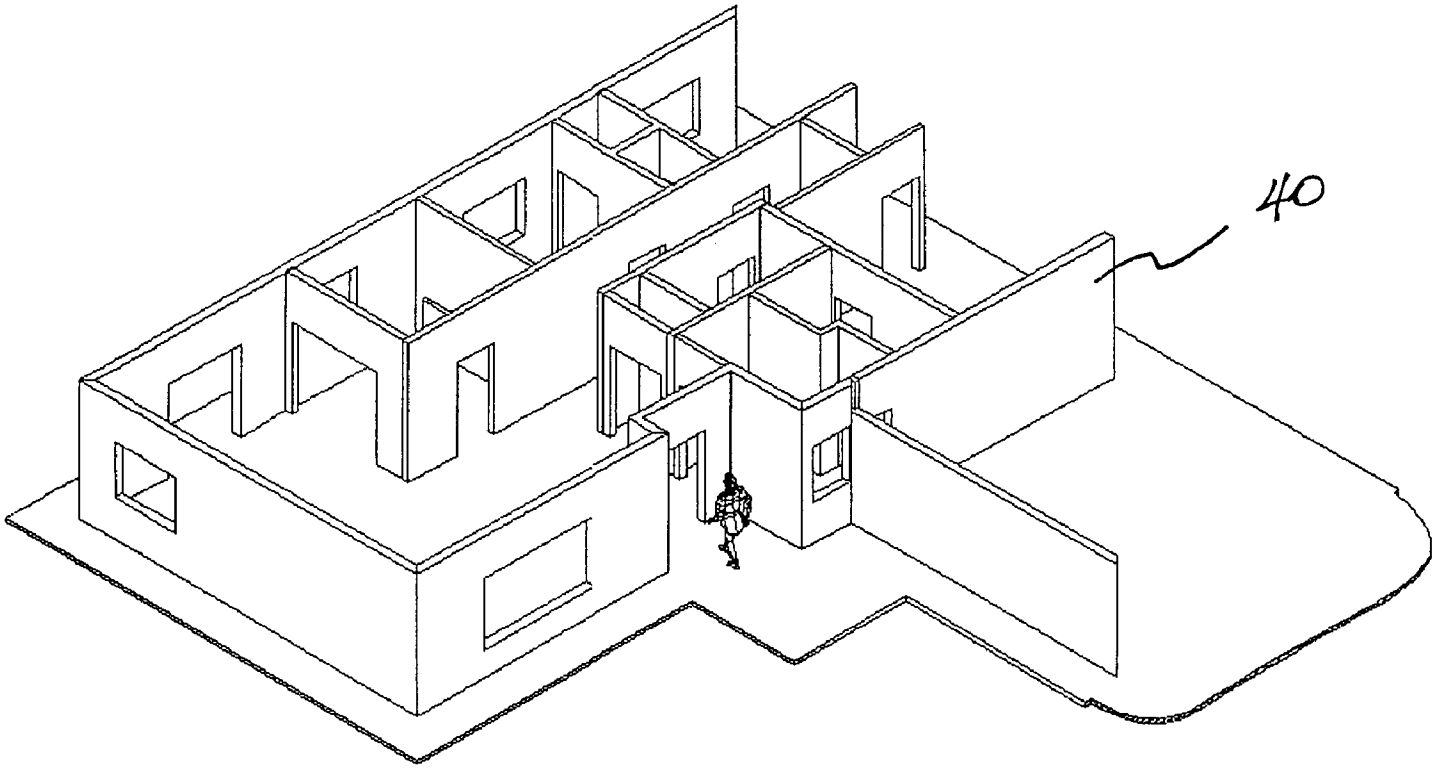

FIG. 12 shows the addition of an inner/garage wall 40.

Figure 13:
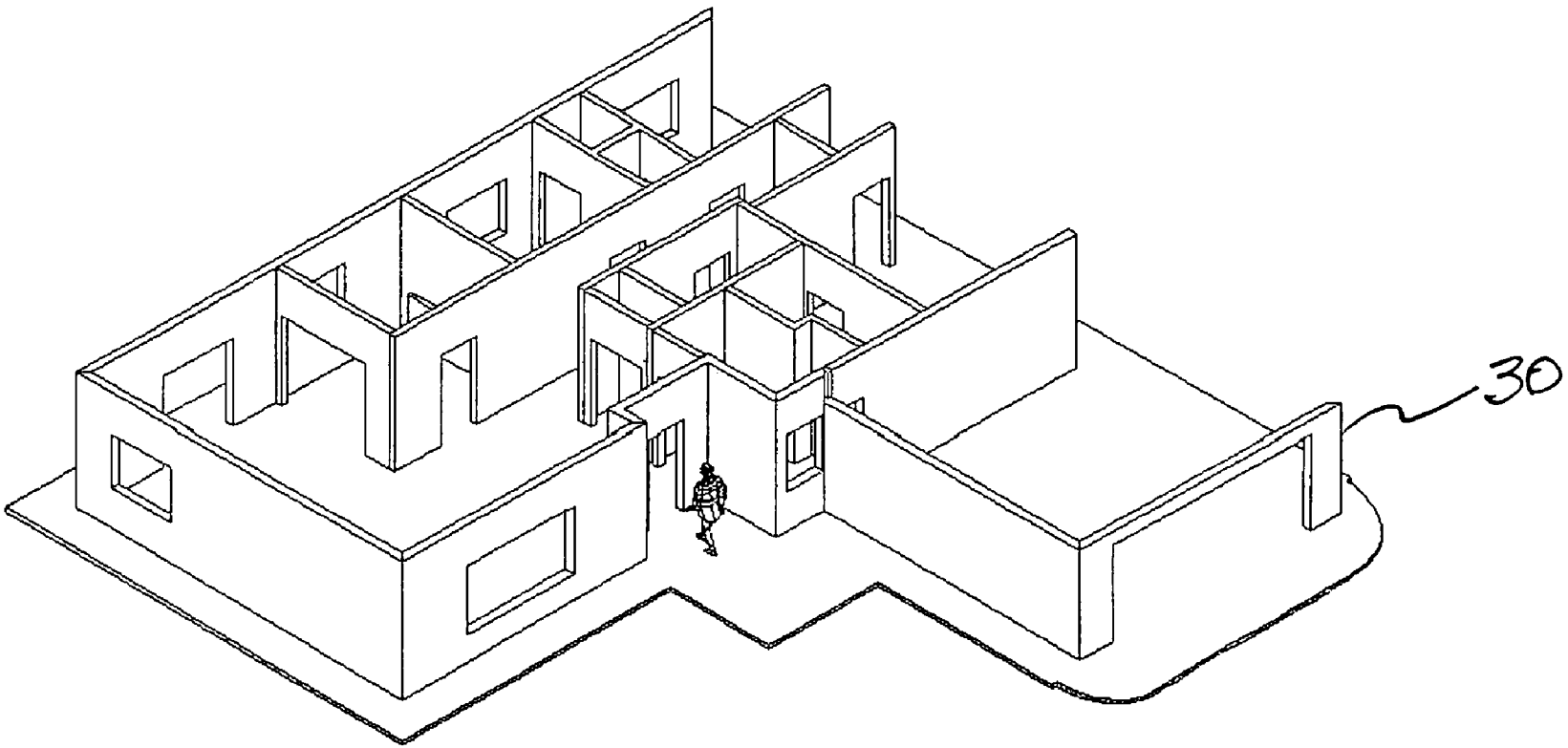
Figure 14:
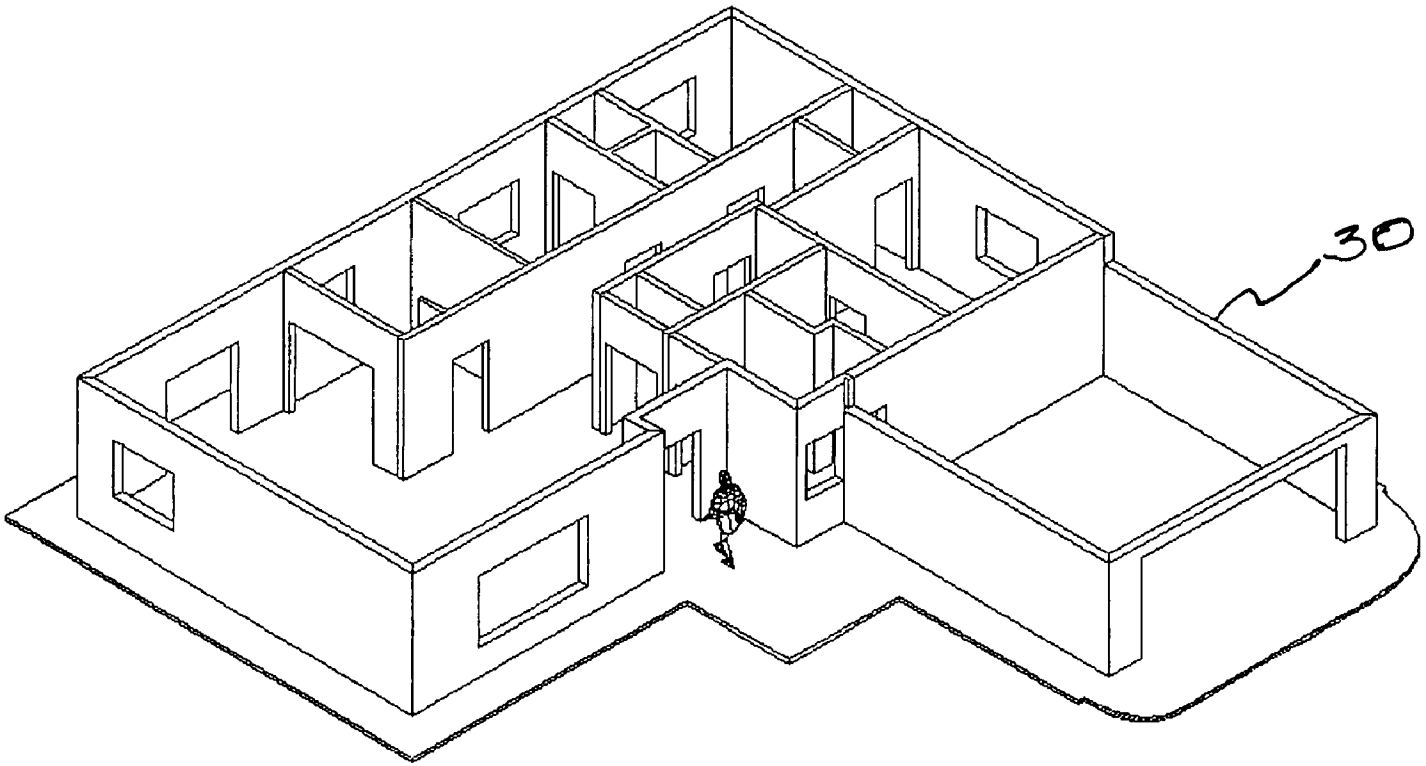

FIGS. 13 and 14 show the addition of outer/garage walls 30.

Figure 15:
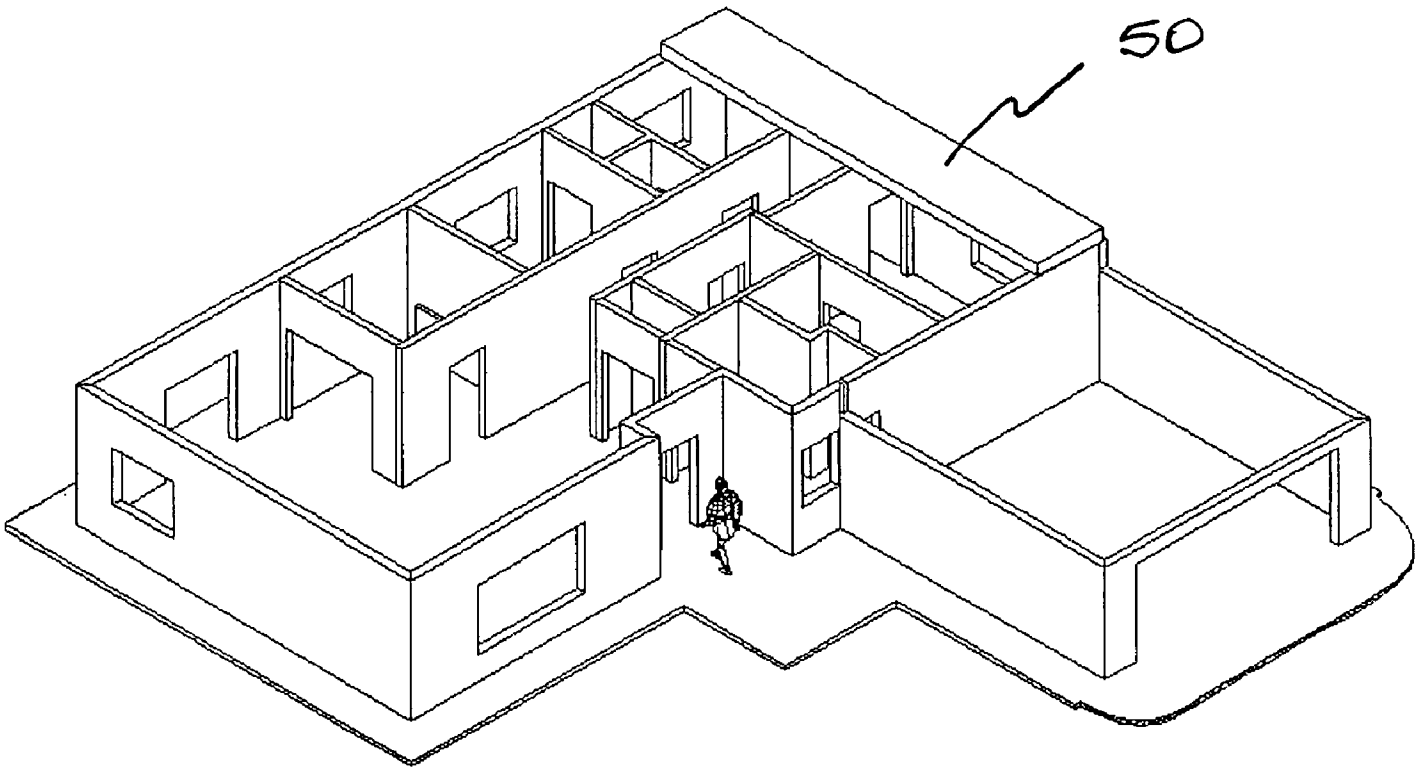
Figure 16:
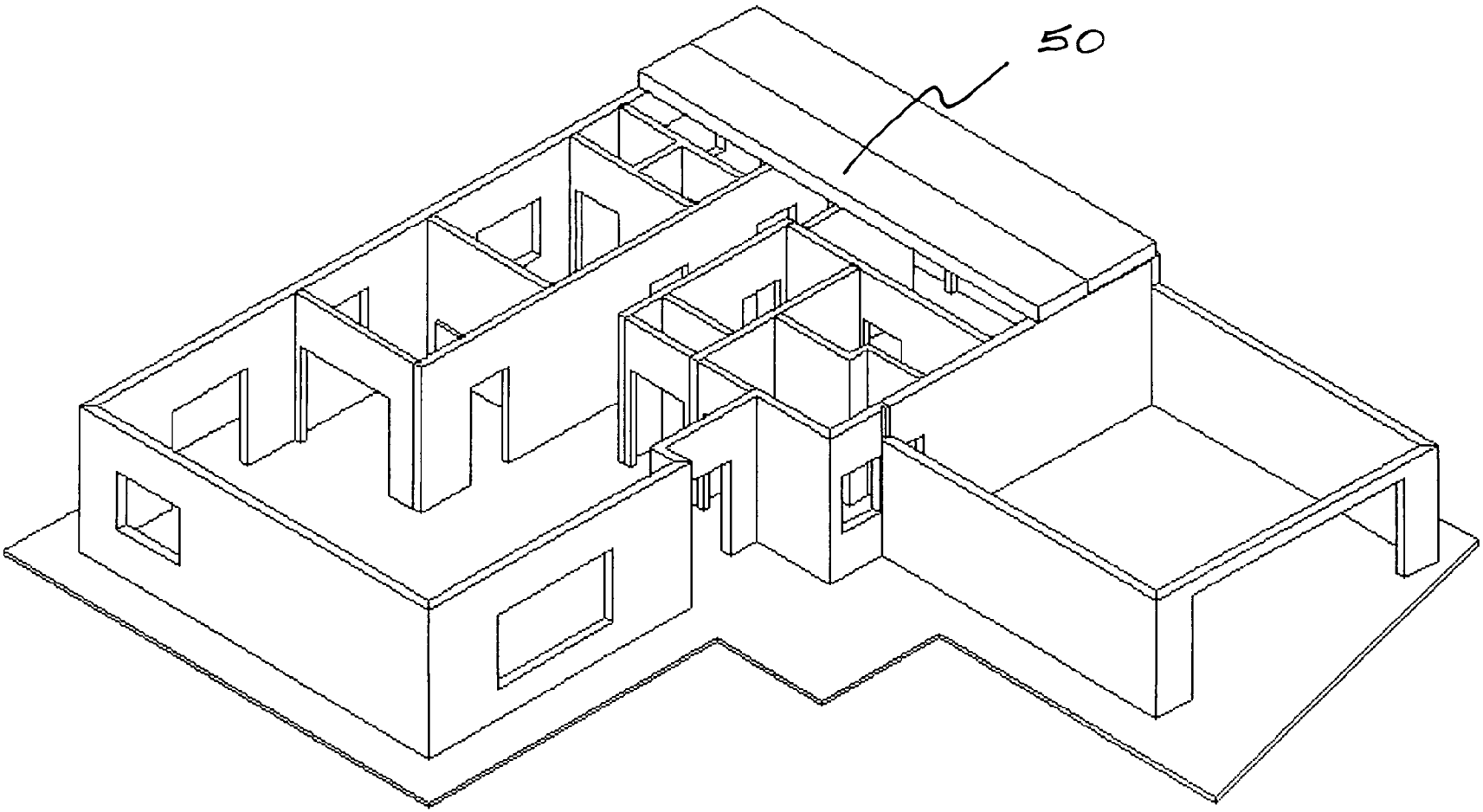
Figure 17:
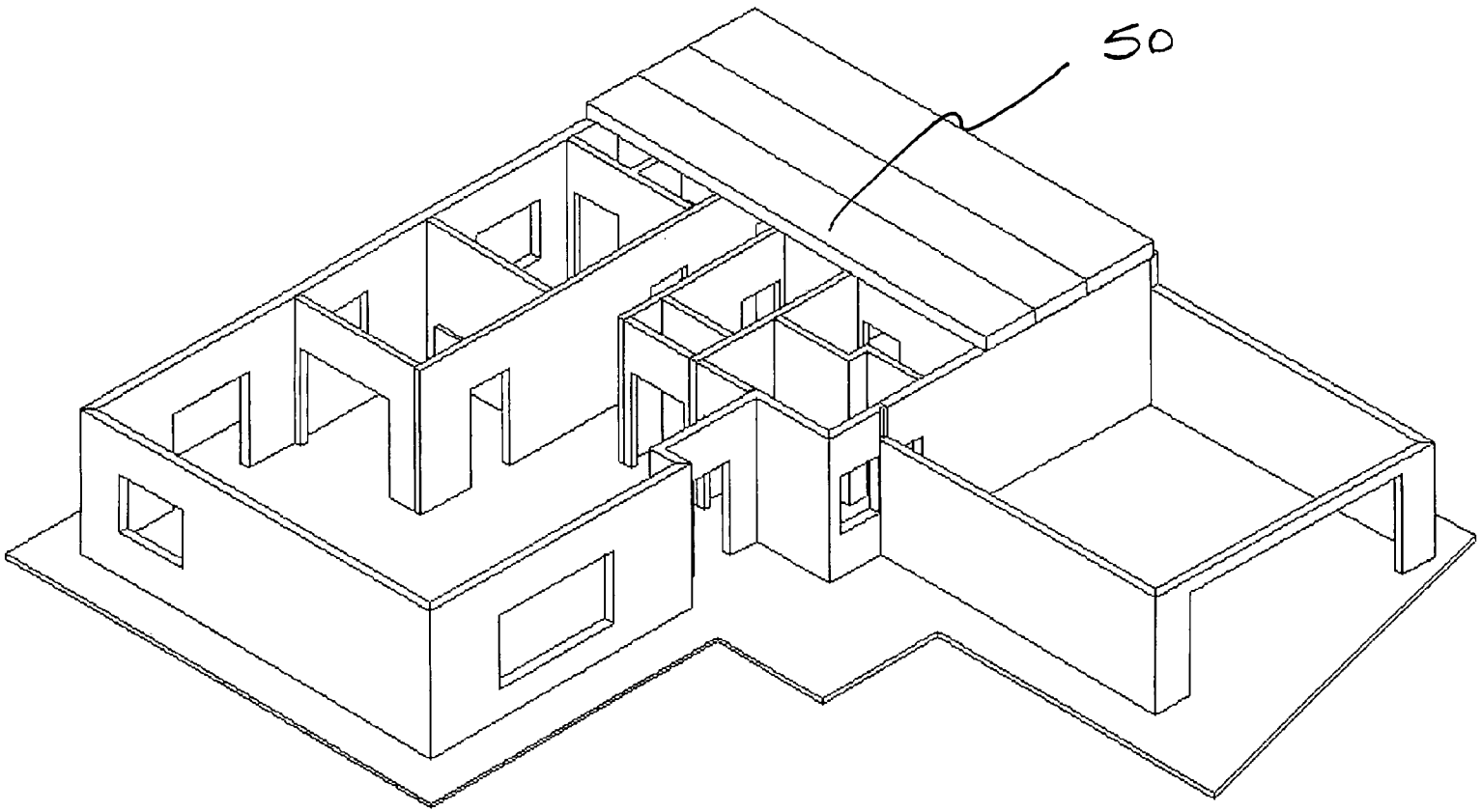
Figure 18:
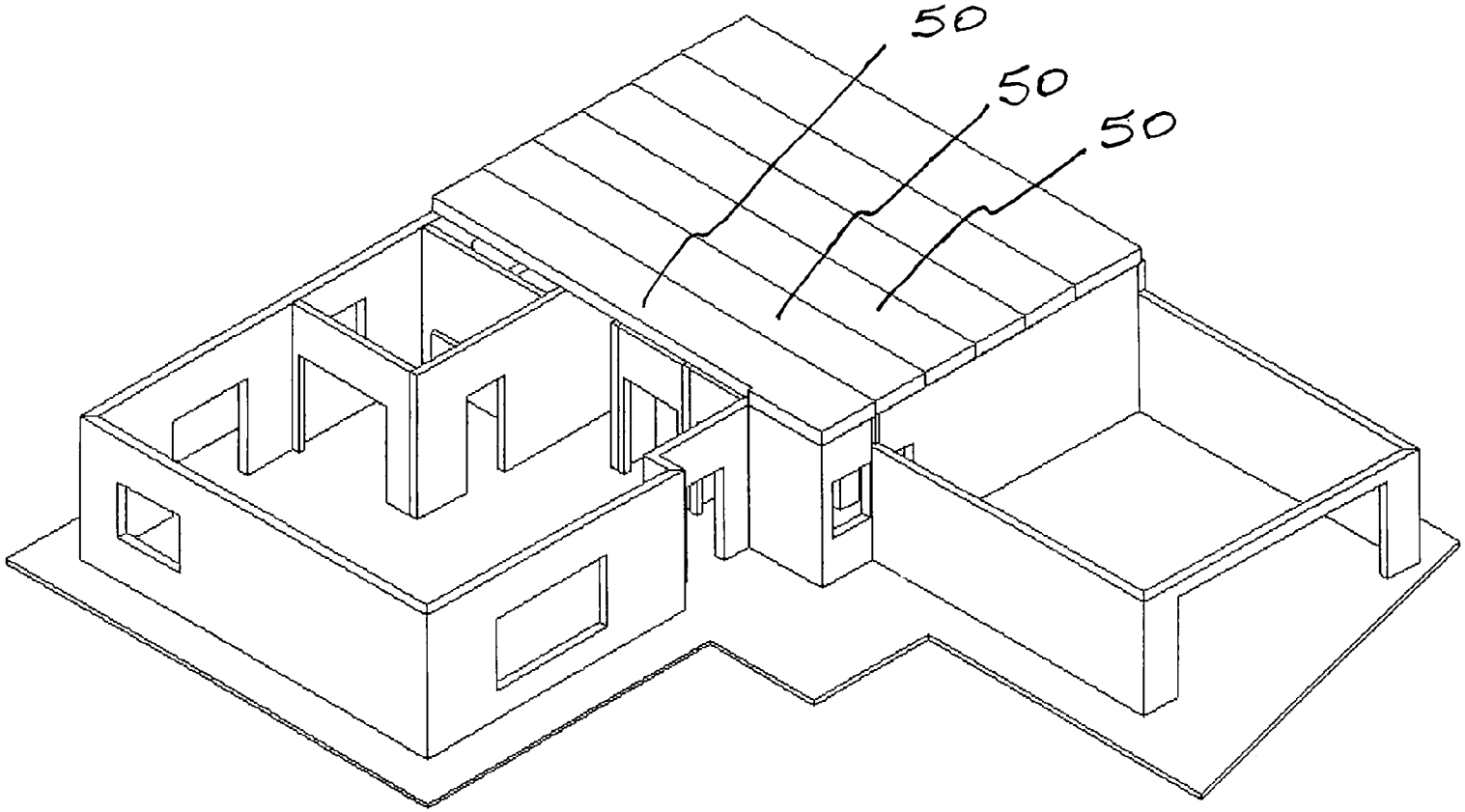
Figure 19:
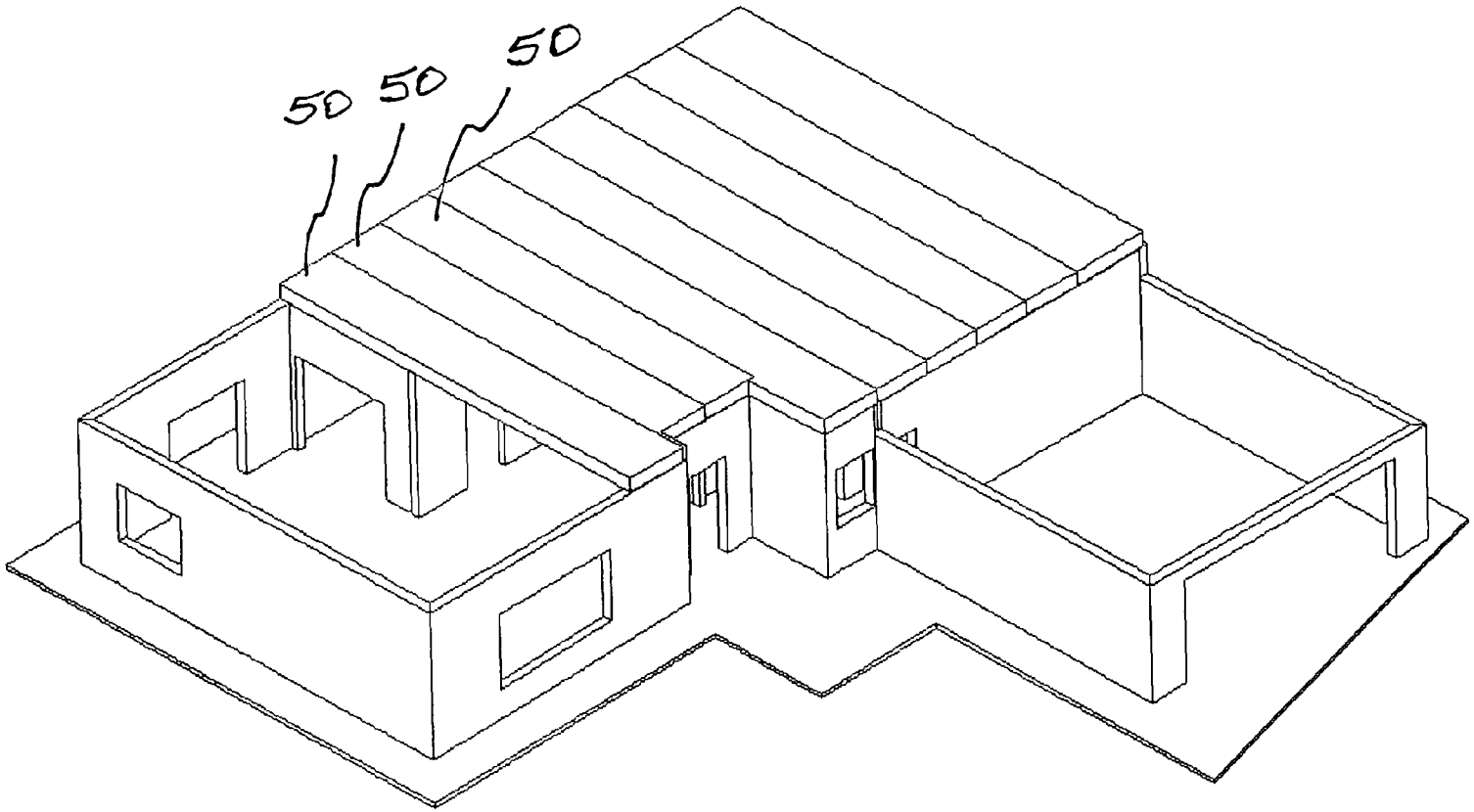
Figure 20:
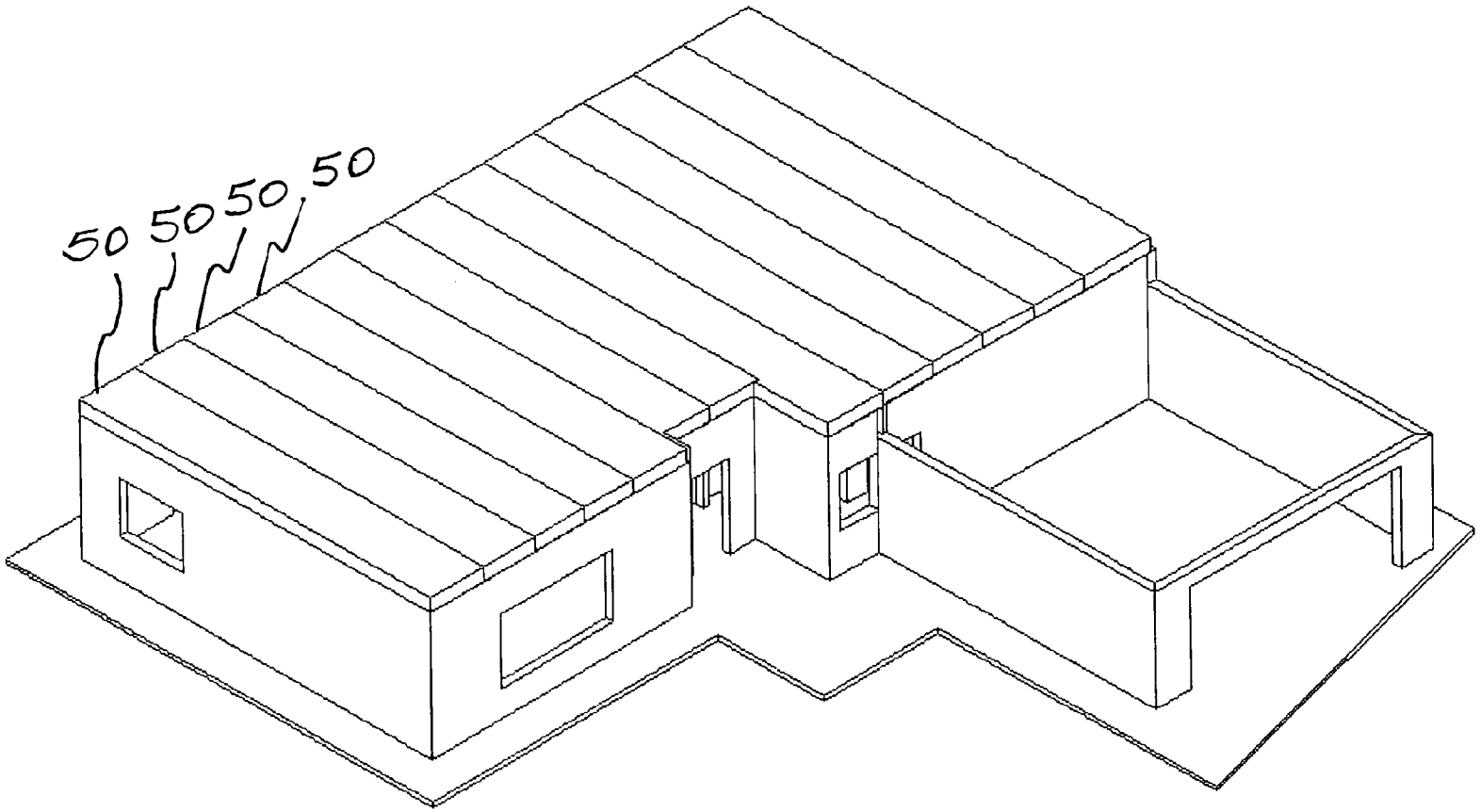
Figure 21:
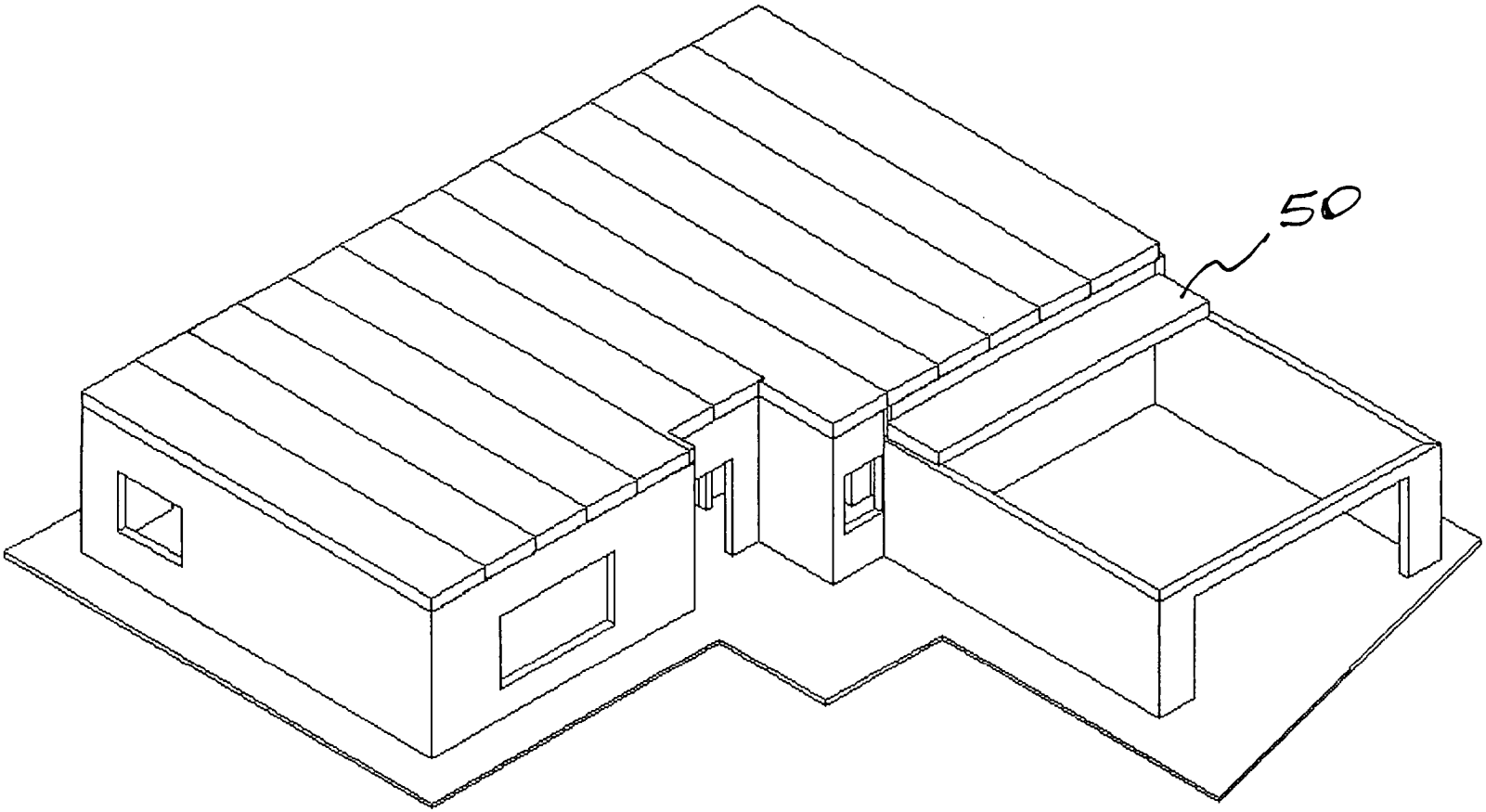
Figure 22:
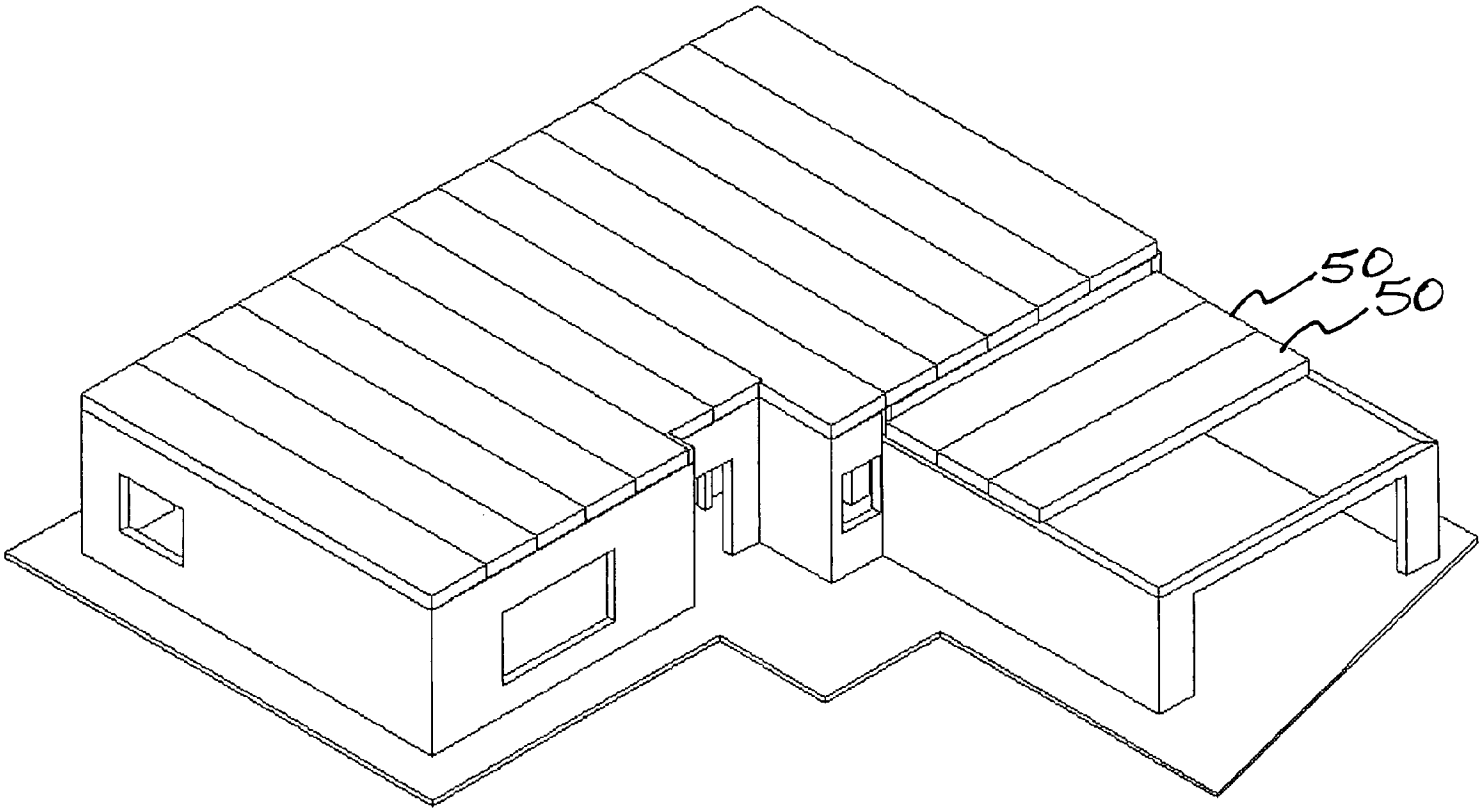
Figure 23:
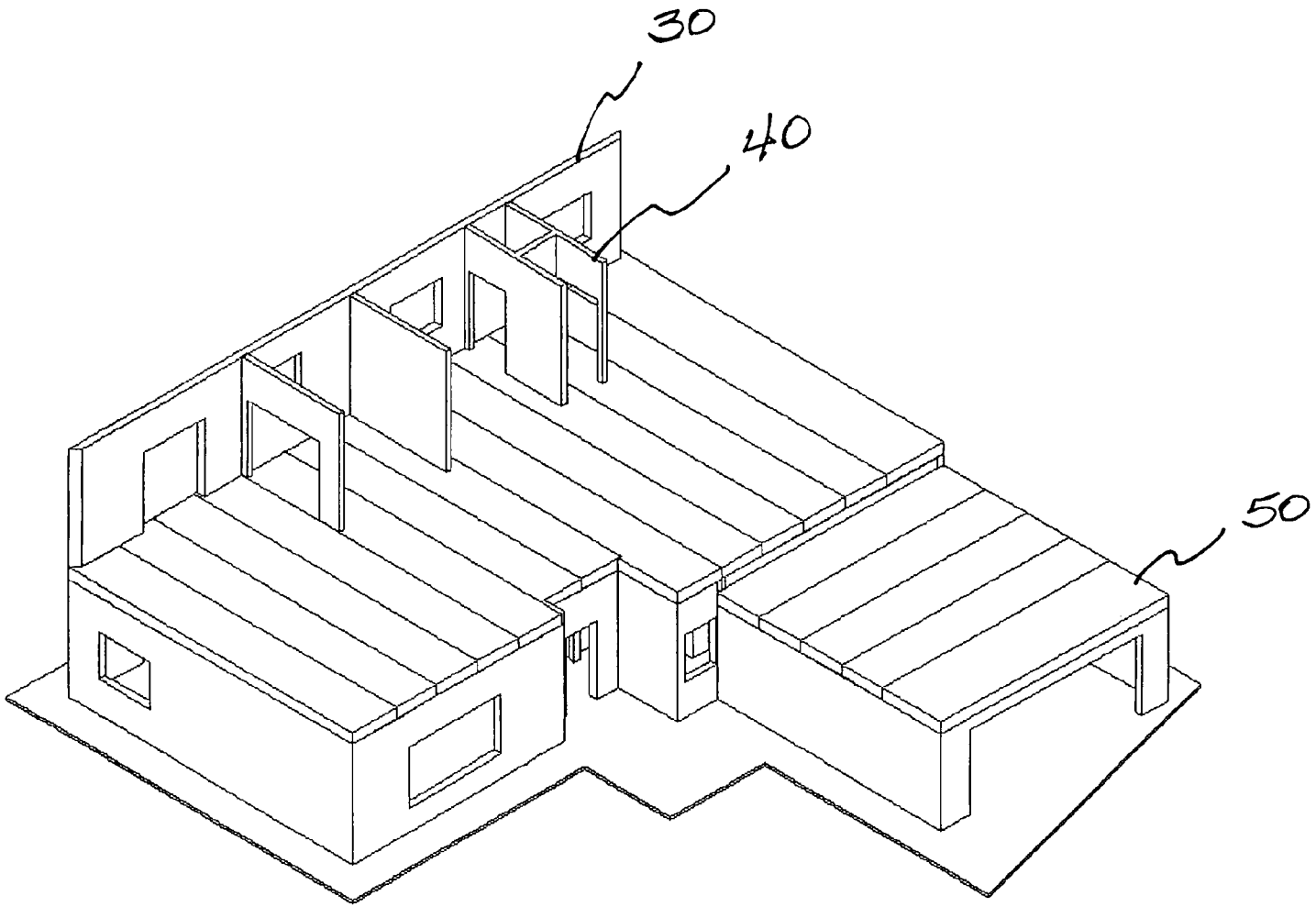
Figure 24:
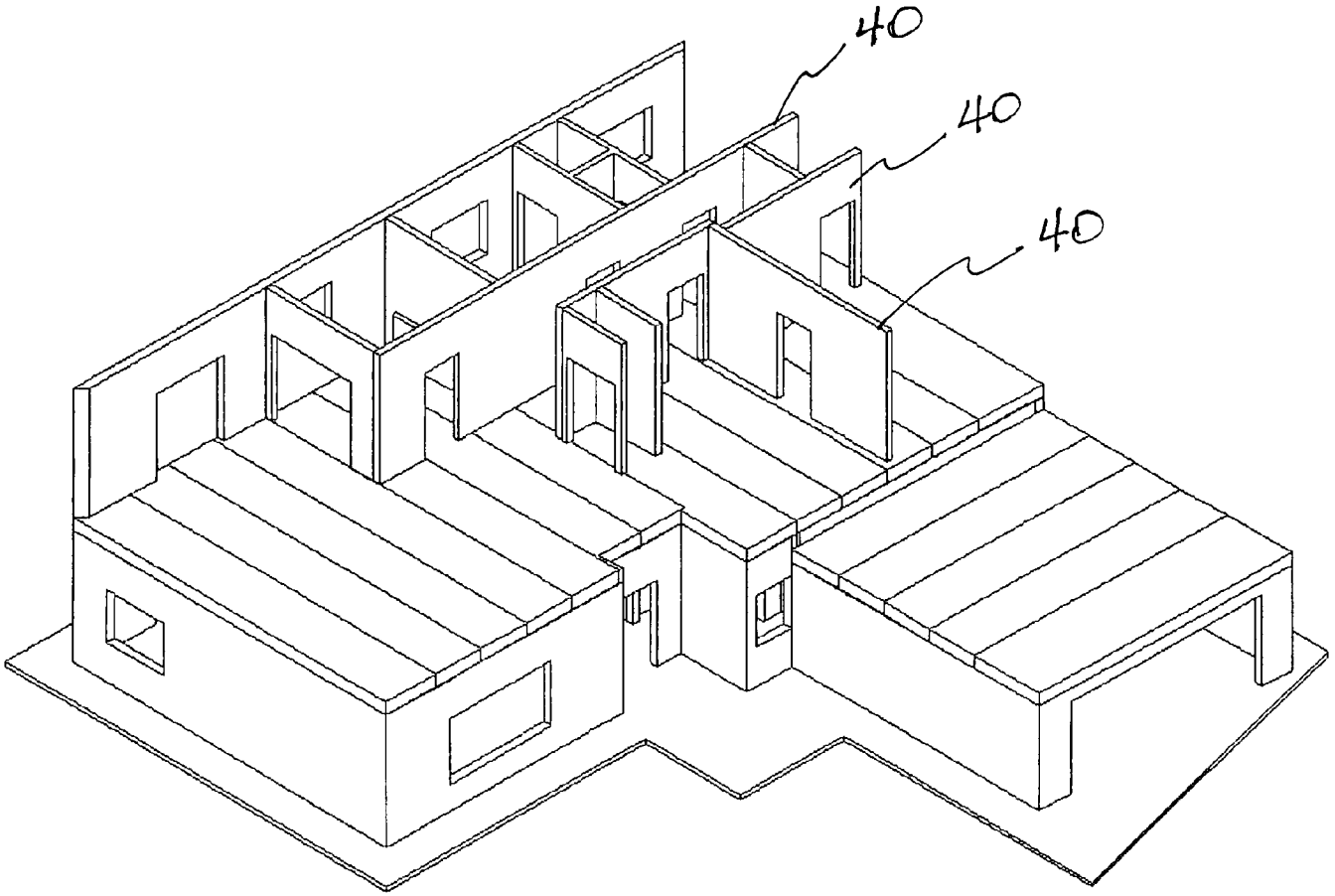
Figure 25:
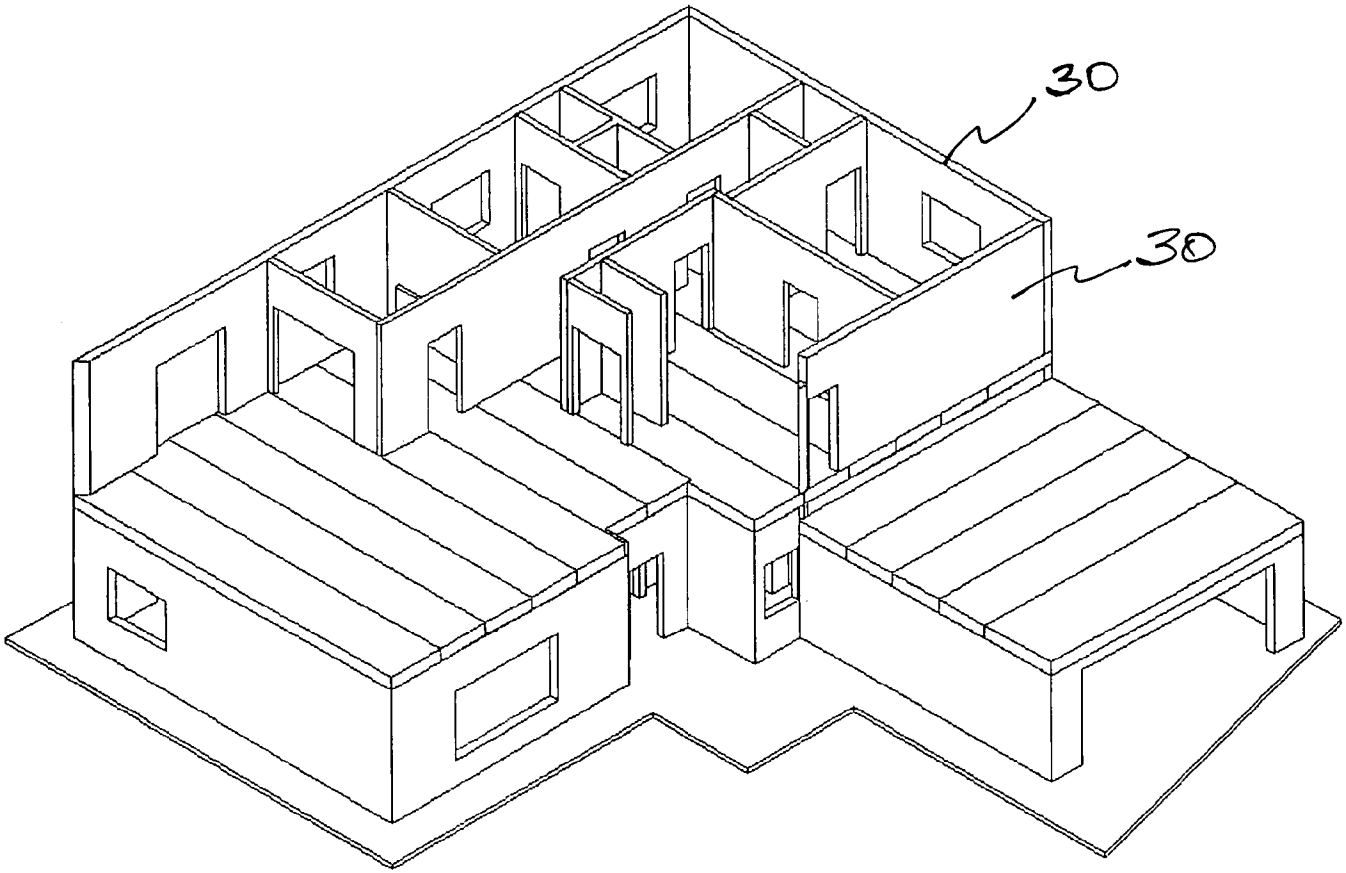

FIG. 15 shows the addition of a ceiling/floor beam 50 to the walls 30, 40. This is done after the bonding agent for the walls is set, 11 hours for GFRC. The beams 50 are panels of foam (12 inches thick) that are coated with GFRC (¼-½ inch coat) and can span at least 27 feet without support. These beams have been subjected to a FEA to predict their performance in the construction phase and full built phase. The workers can walk on the beams once they are in place. The side edges of the beams are joined to the next abutting beam by a bonding agent which can be an expansive plastic foam, such as Expansive PolyUrethane (EPU), etc. The outer surface of the joint is later covered with a GFRC grout.

FIGS. 16-22 show the addition of more ceiling/floor beams 50.

Figure 26:
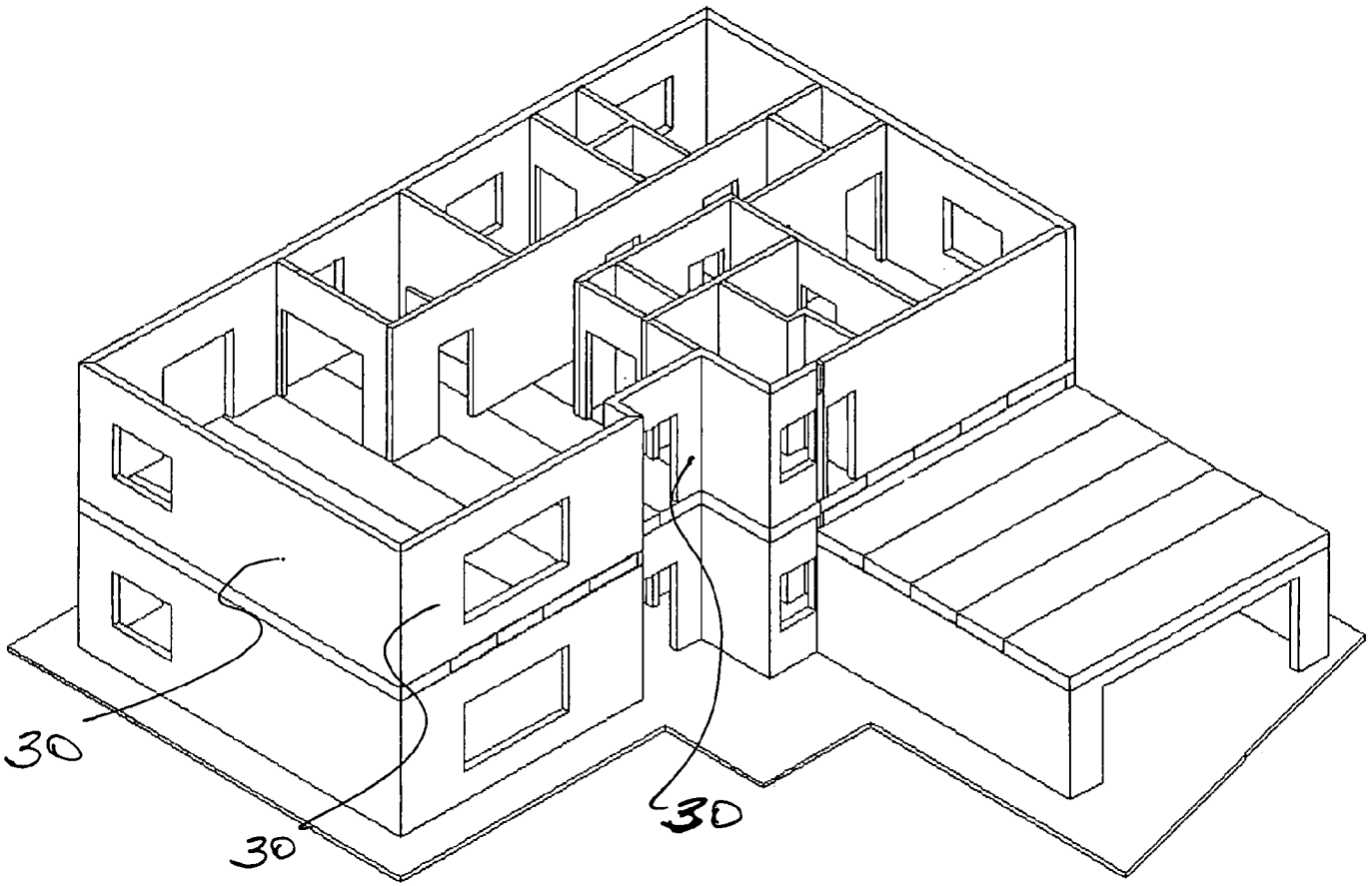
Figure 27:
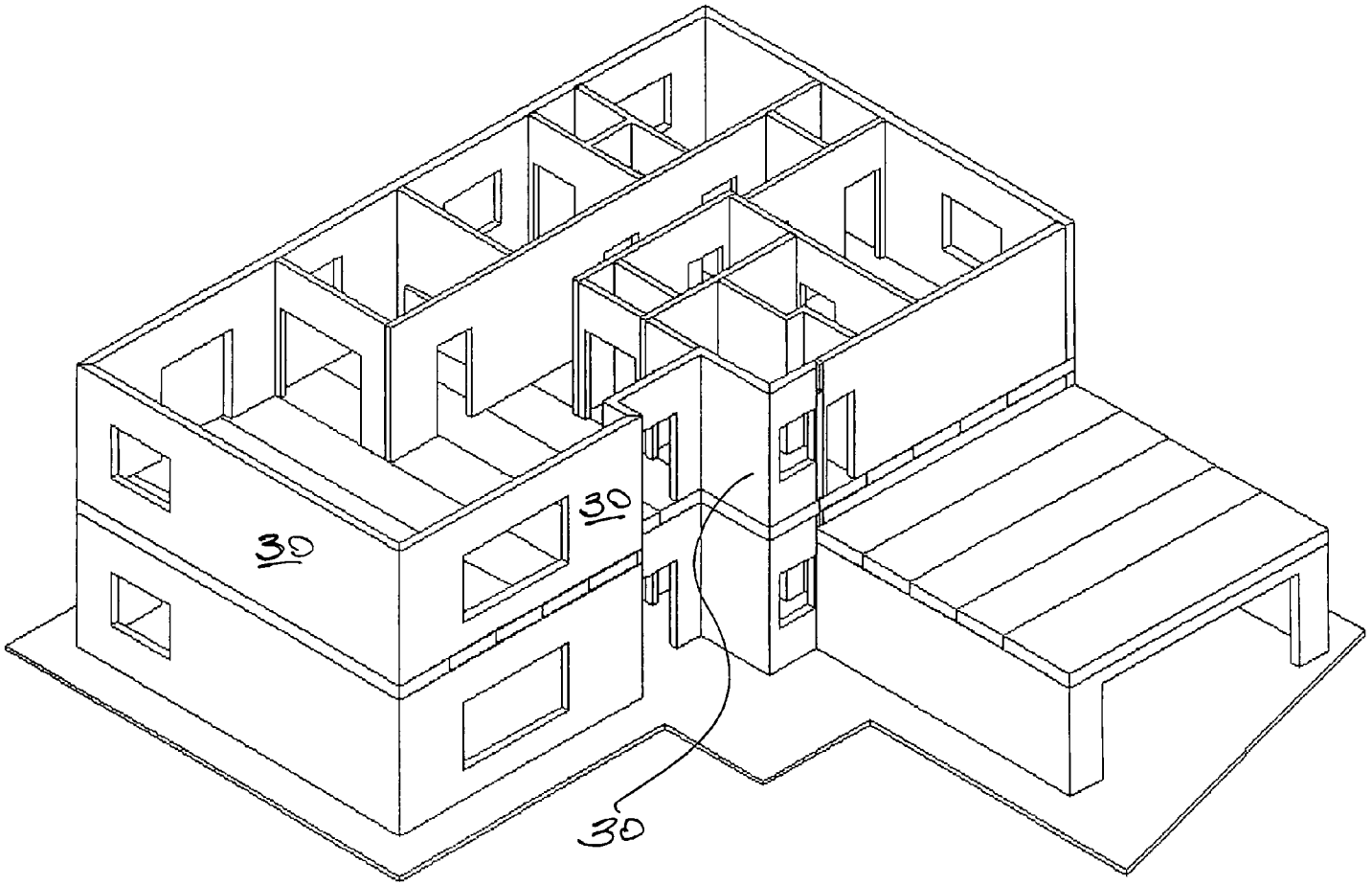

FIGS. 23-27 show the addition of the second floor outer and inner walls 30, 40. FIGS. 26 and 27 are duplicates.

Figure 28:
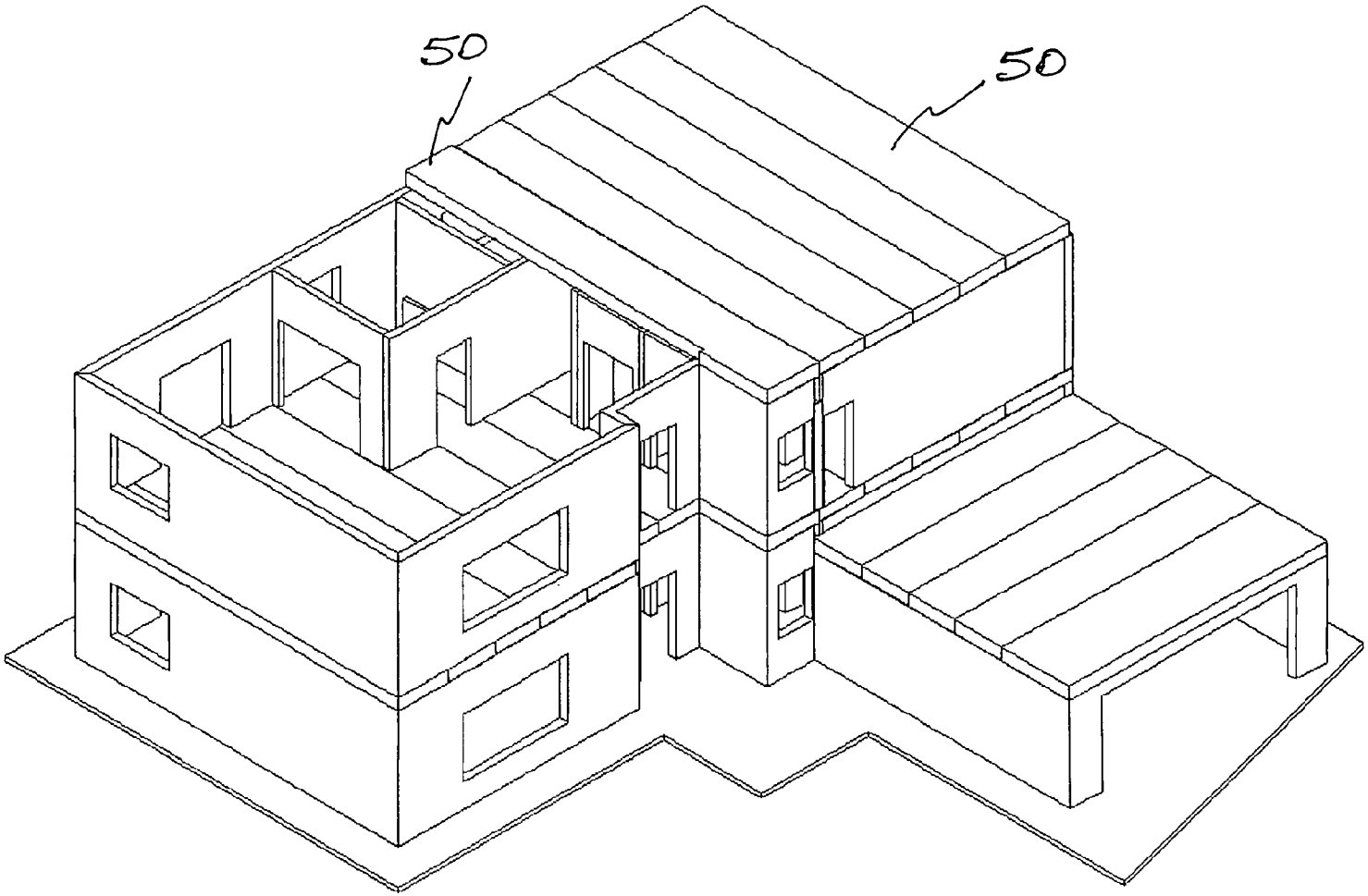
Figure 29:
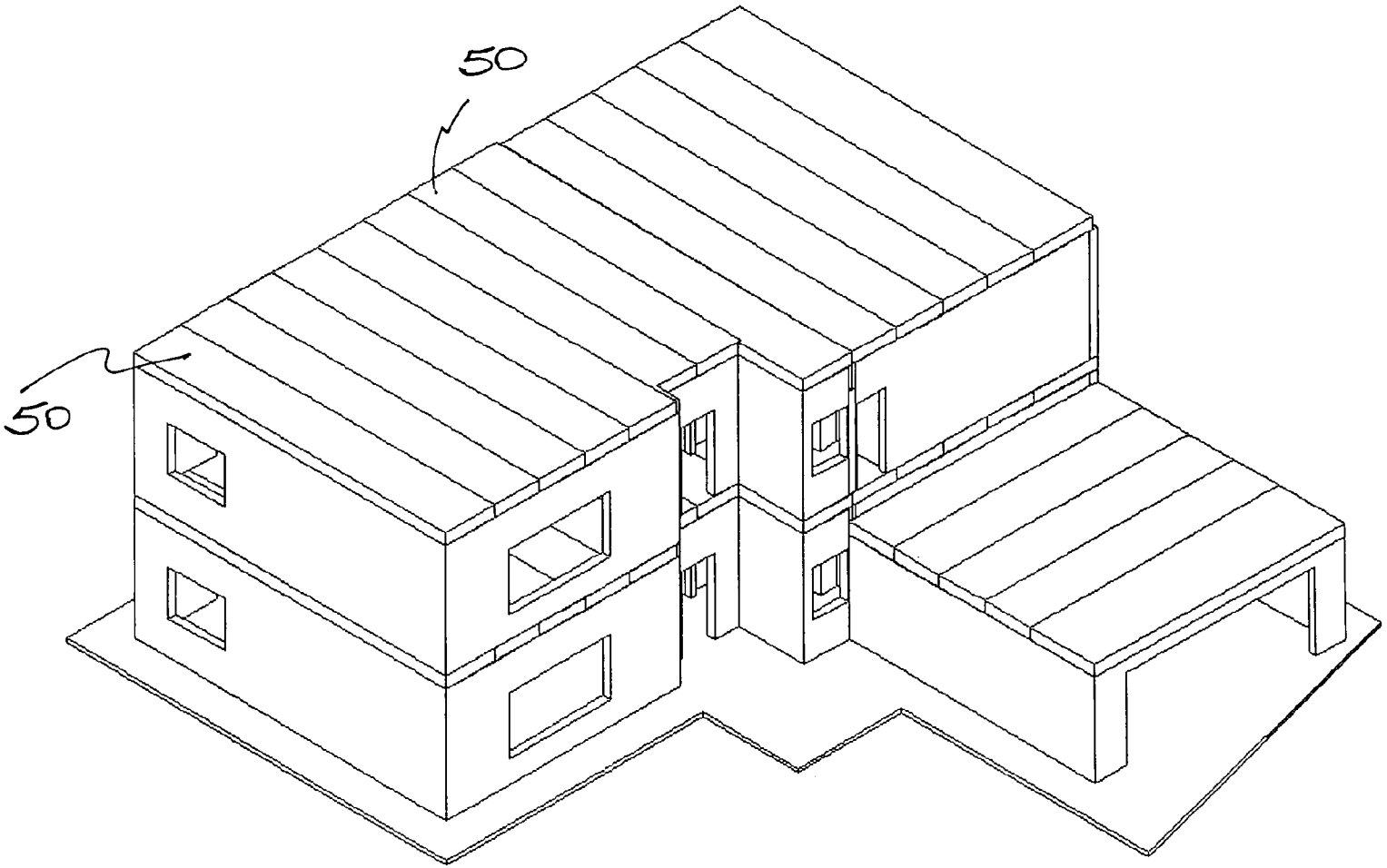

FIGS. 28 and 29 show the addition of the second floor ceiling/floor beams 50 to the second floor walls.

Figure 30:
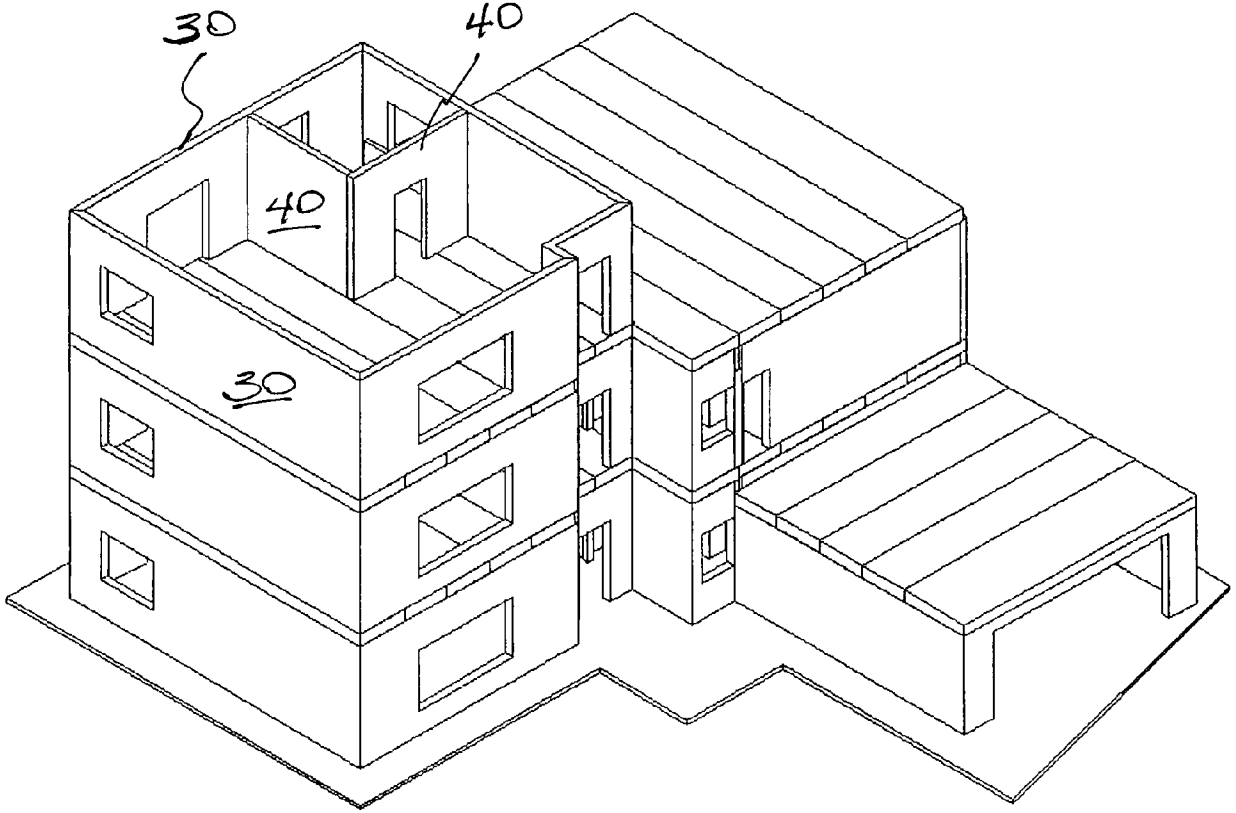

FIG. 30 shows the addition of the third floor outer and inner walls 30, 40.

Figure 31:
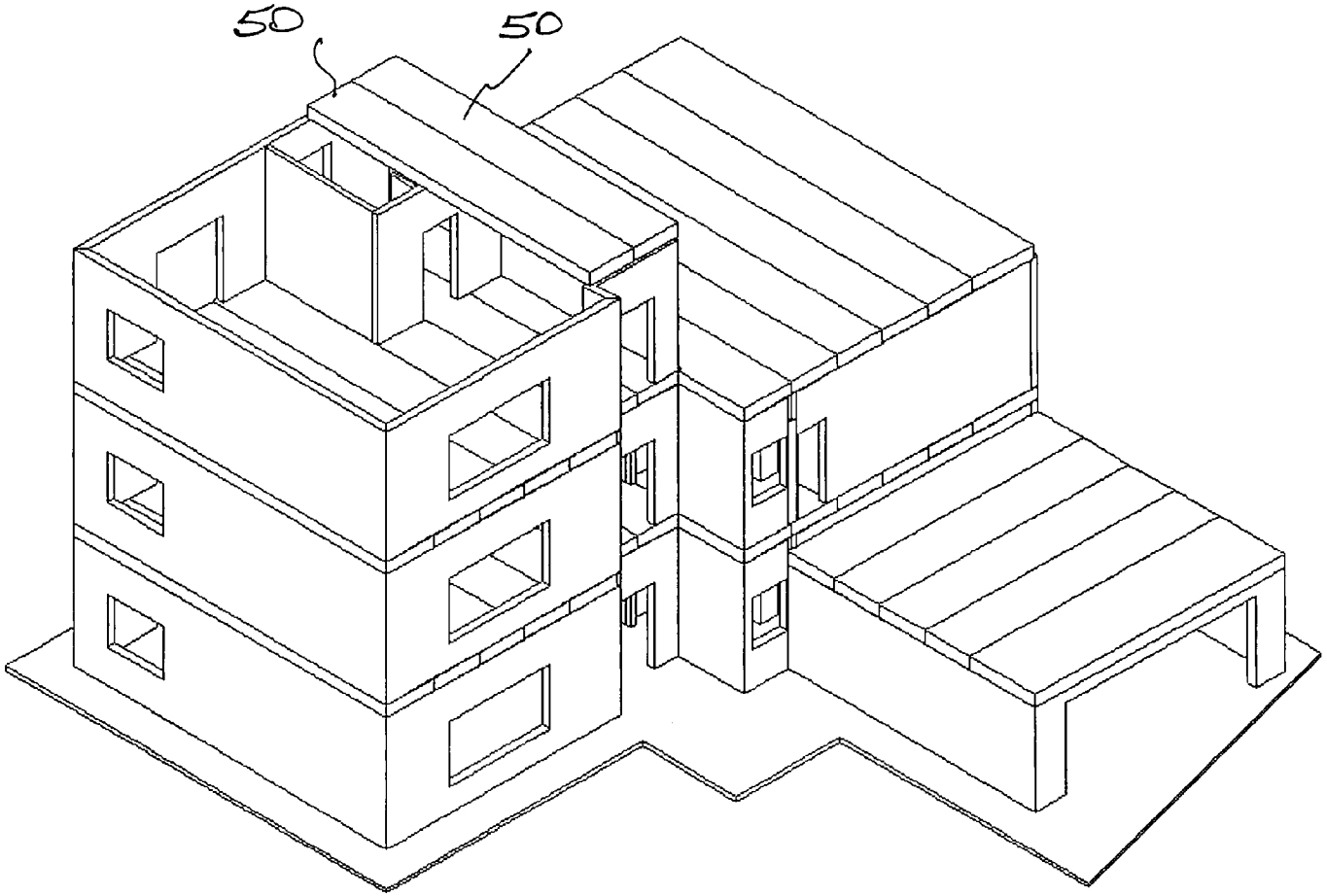
Figure 32:
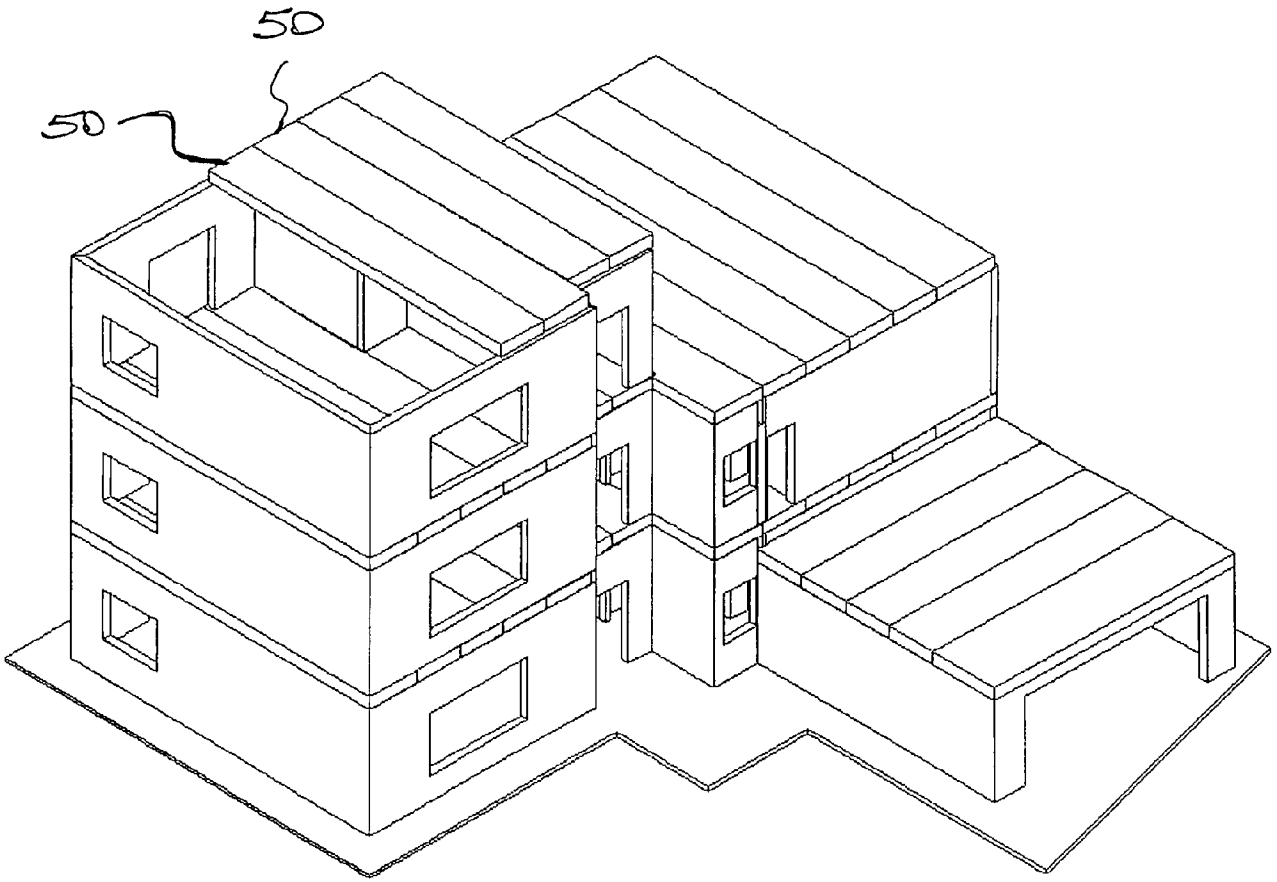
Figure 33:
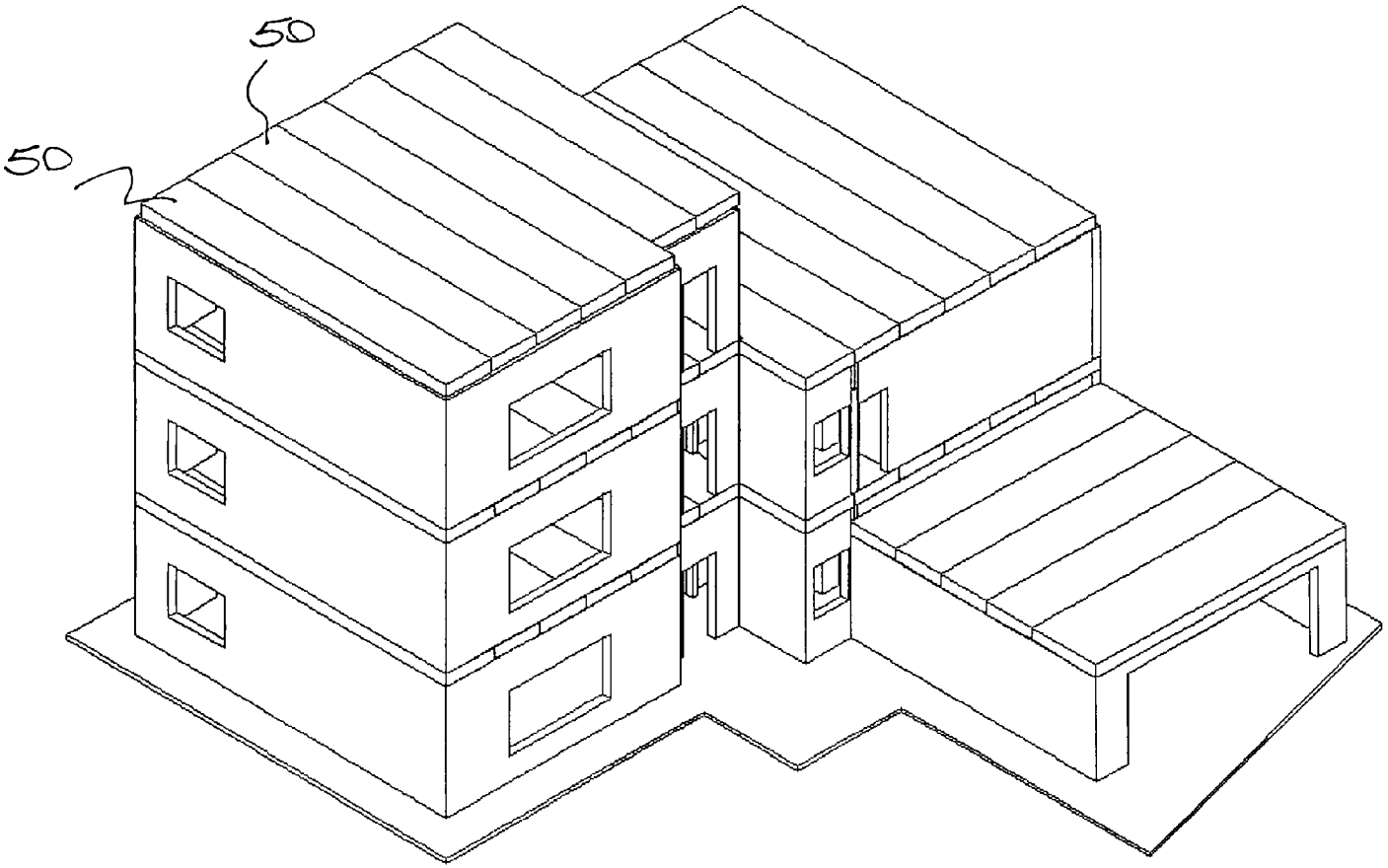
Figure 34:
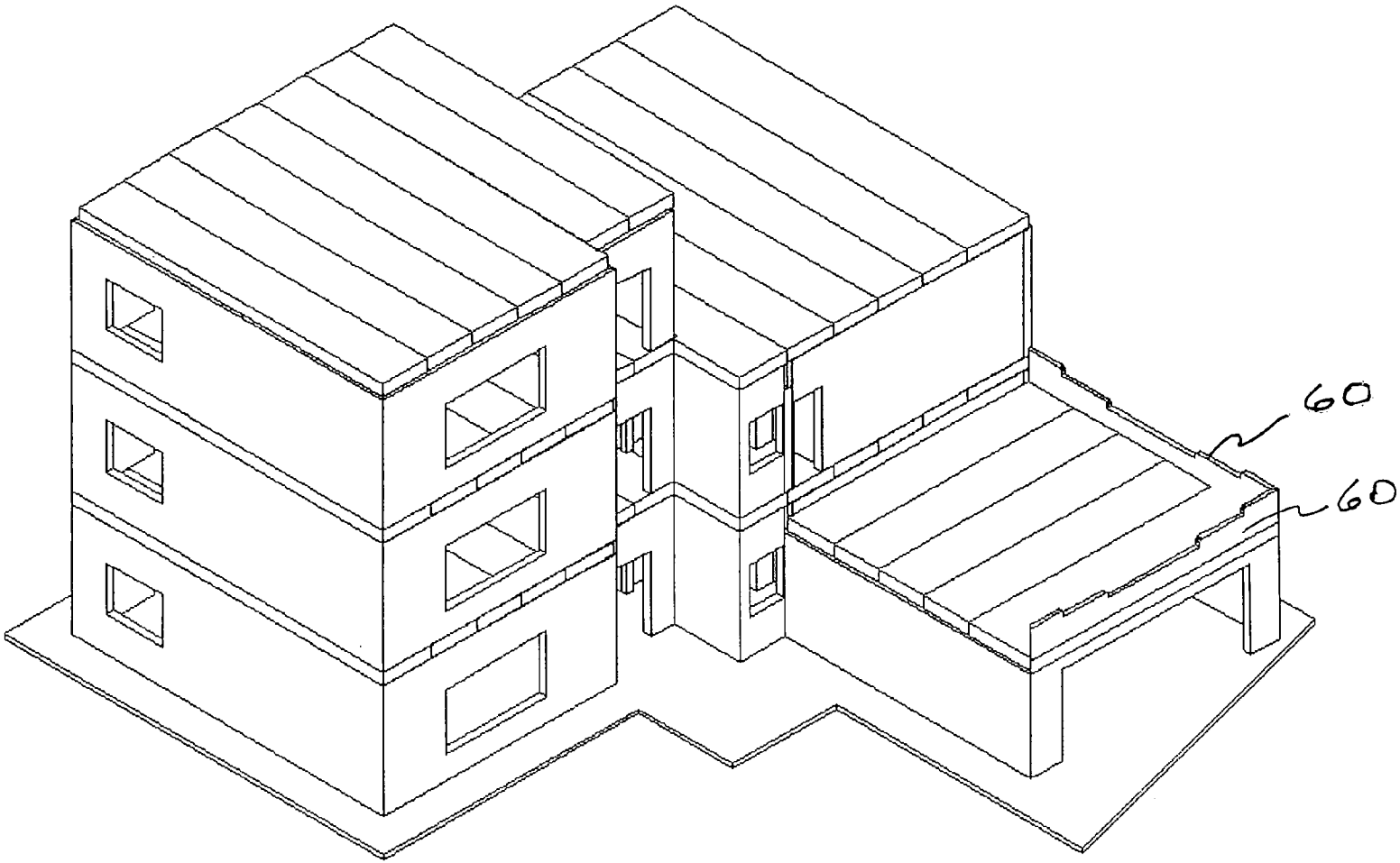
Figure 35:
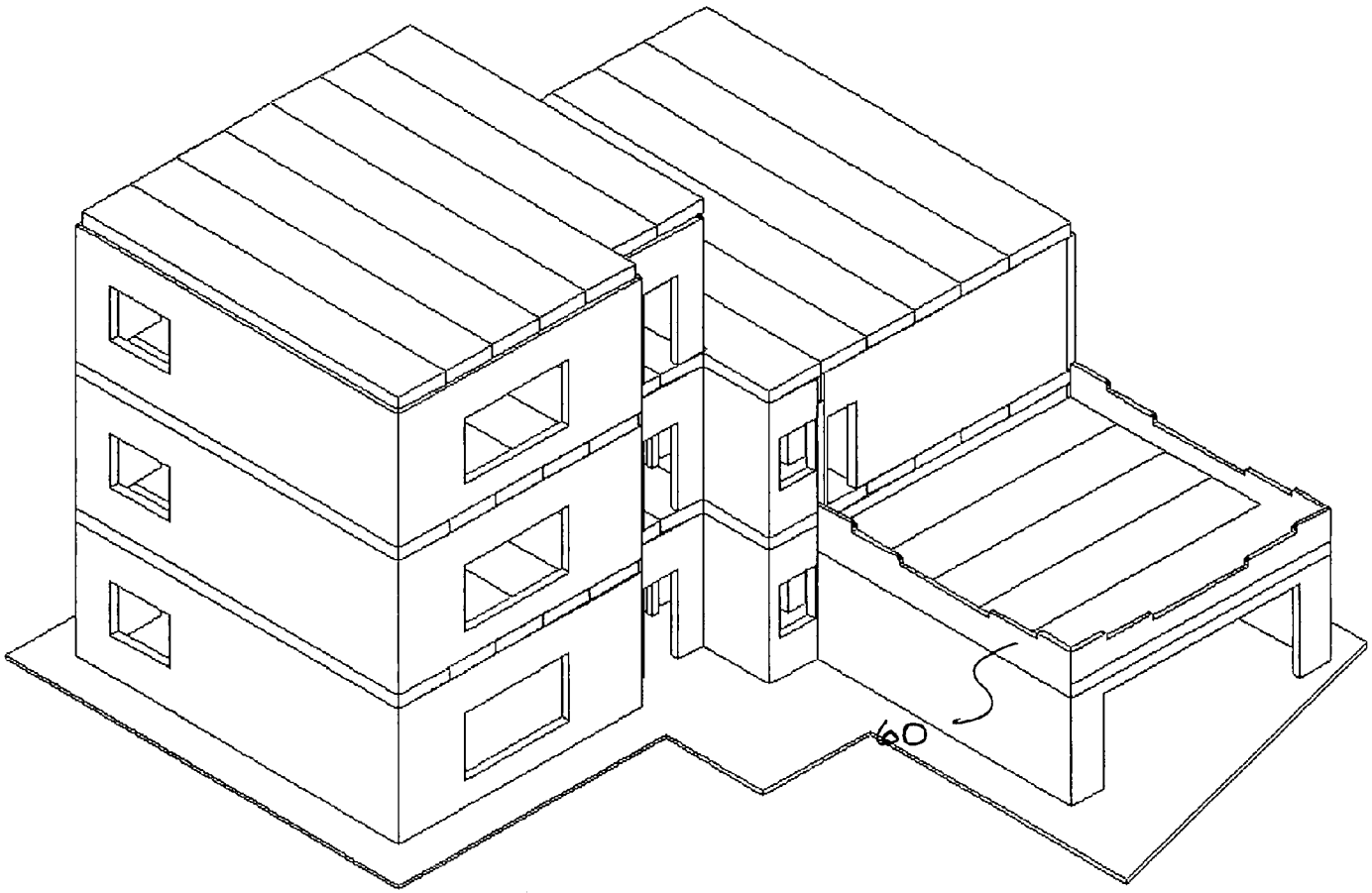
Figure 36:
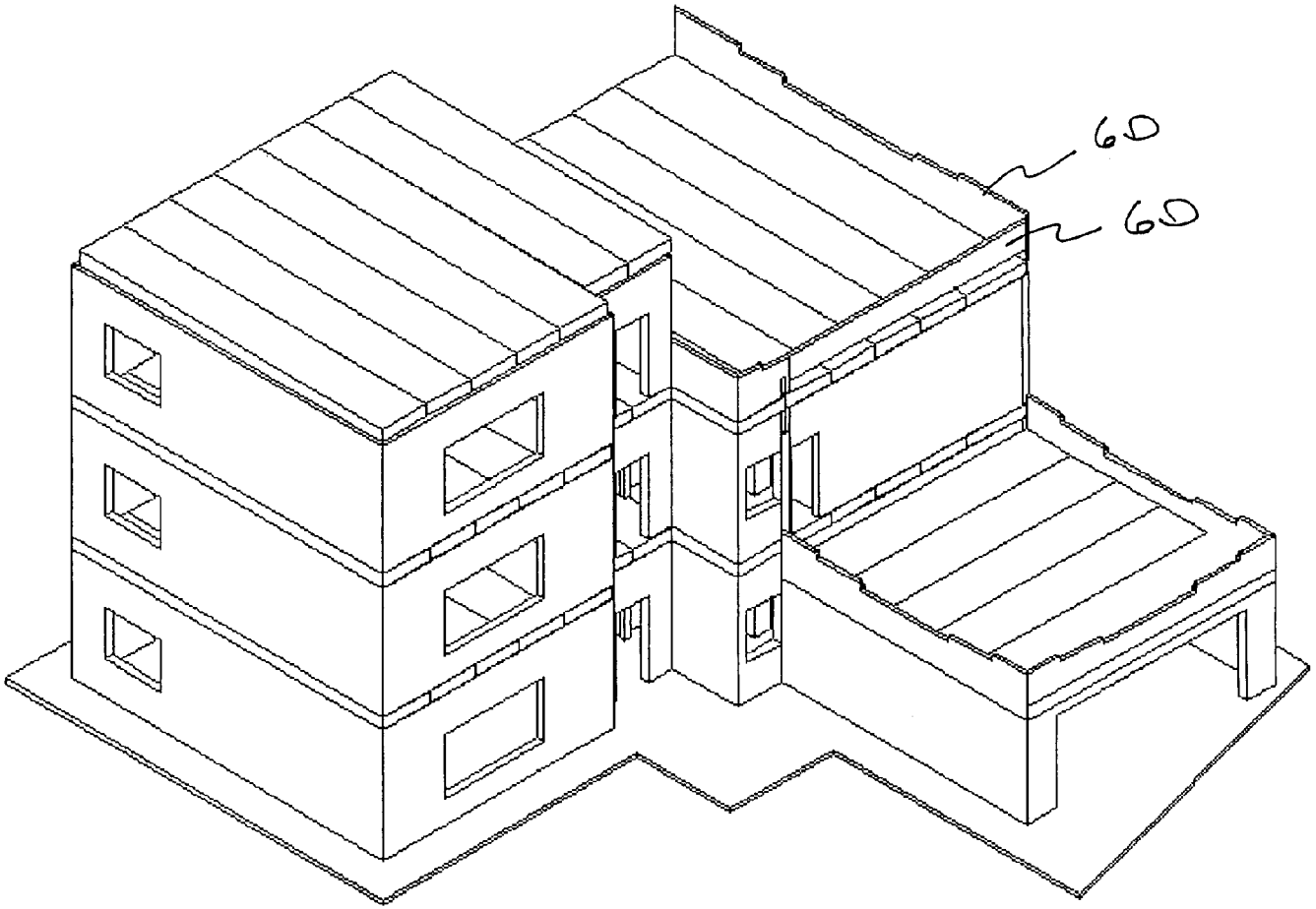
Figure 37:
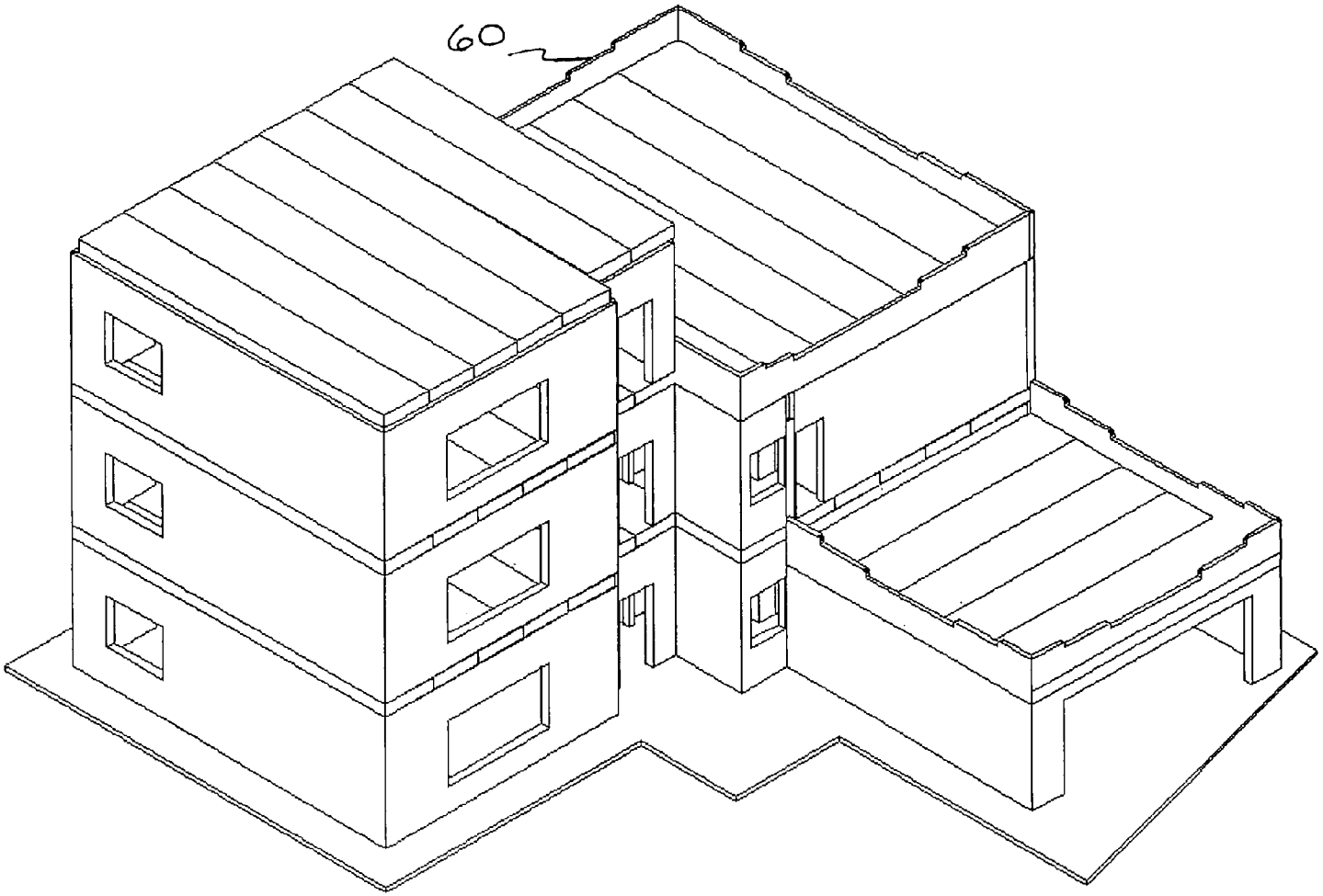

FIGS. 31-33 show the addition of ceiling/roof beams 50 to the third floor walls.

Figure 38:
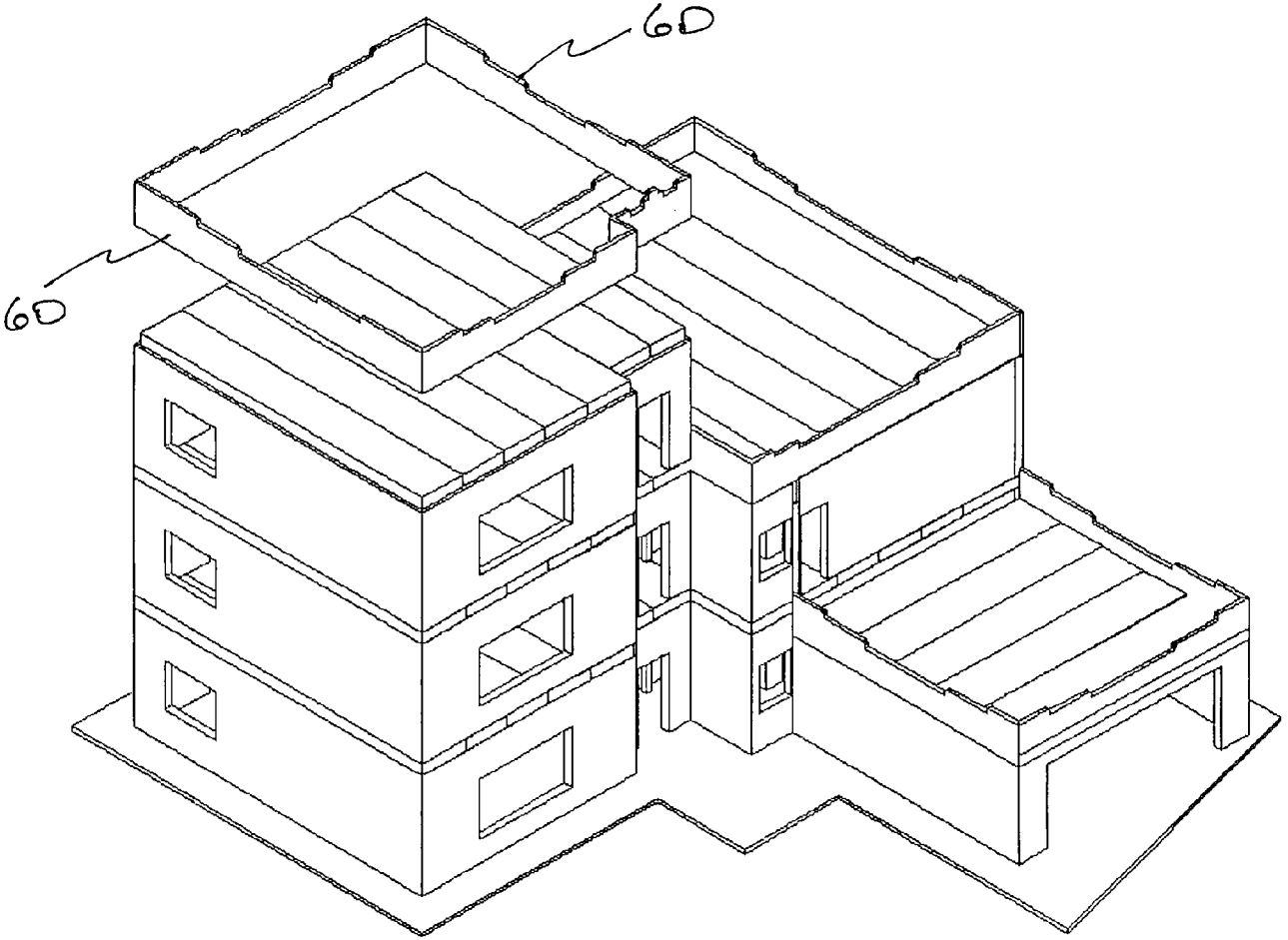
Figure 39:
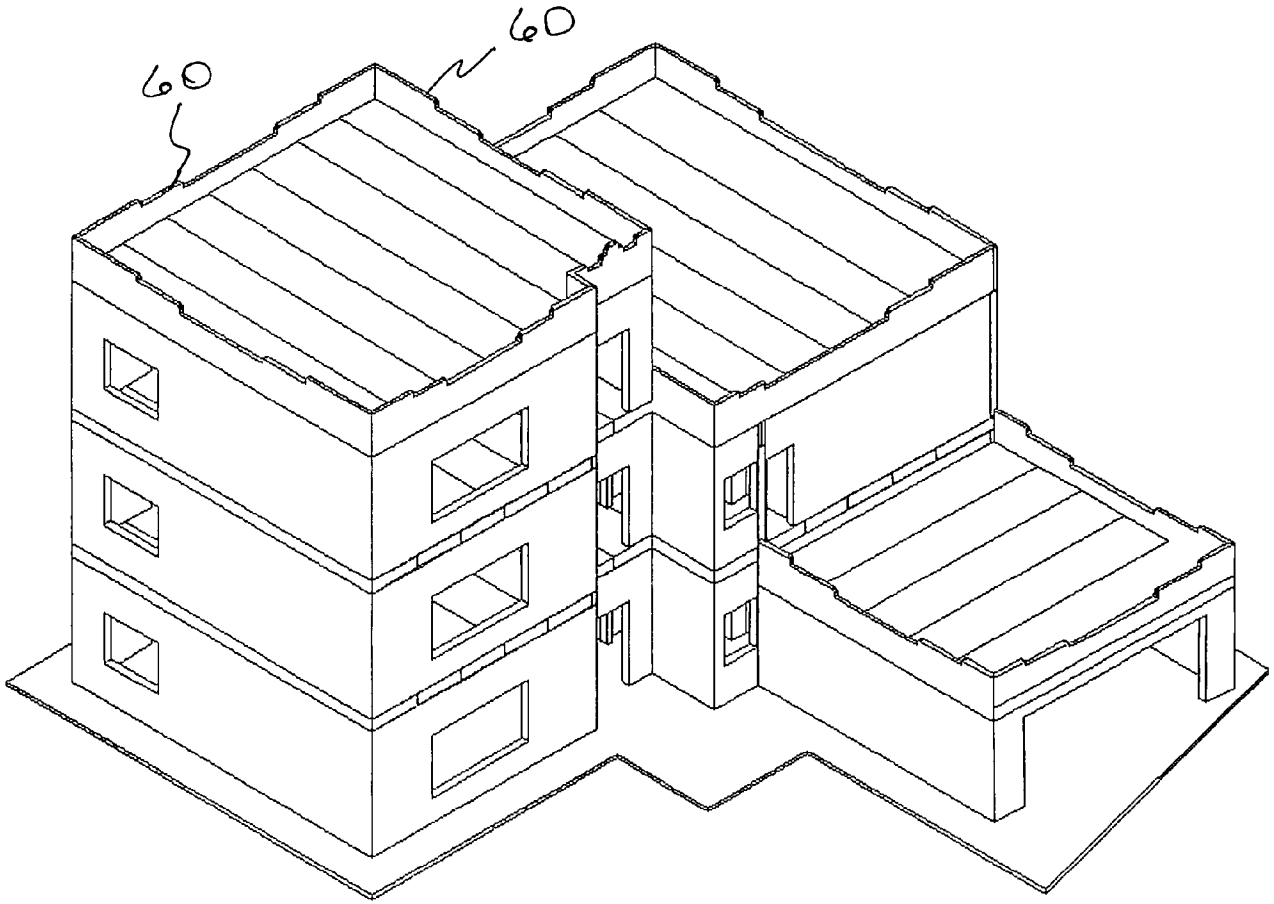

FIGS. 34-39 show the addition of parapet walls 60 to the roof. FIG. 38 show an alternative in which a complete parapet wall is constructed on the ground and is lifted by crane to for addition to the roof.

Figure 40:
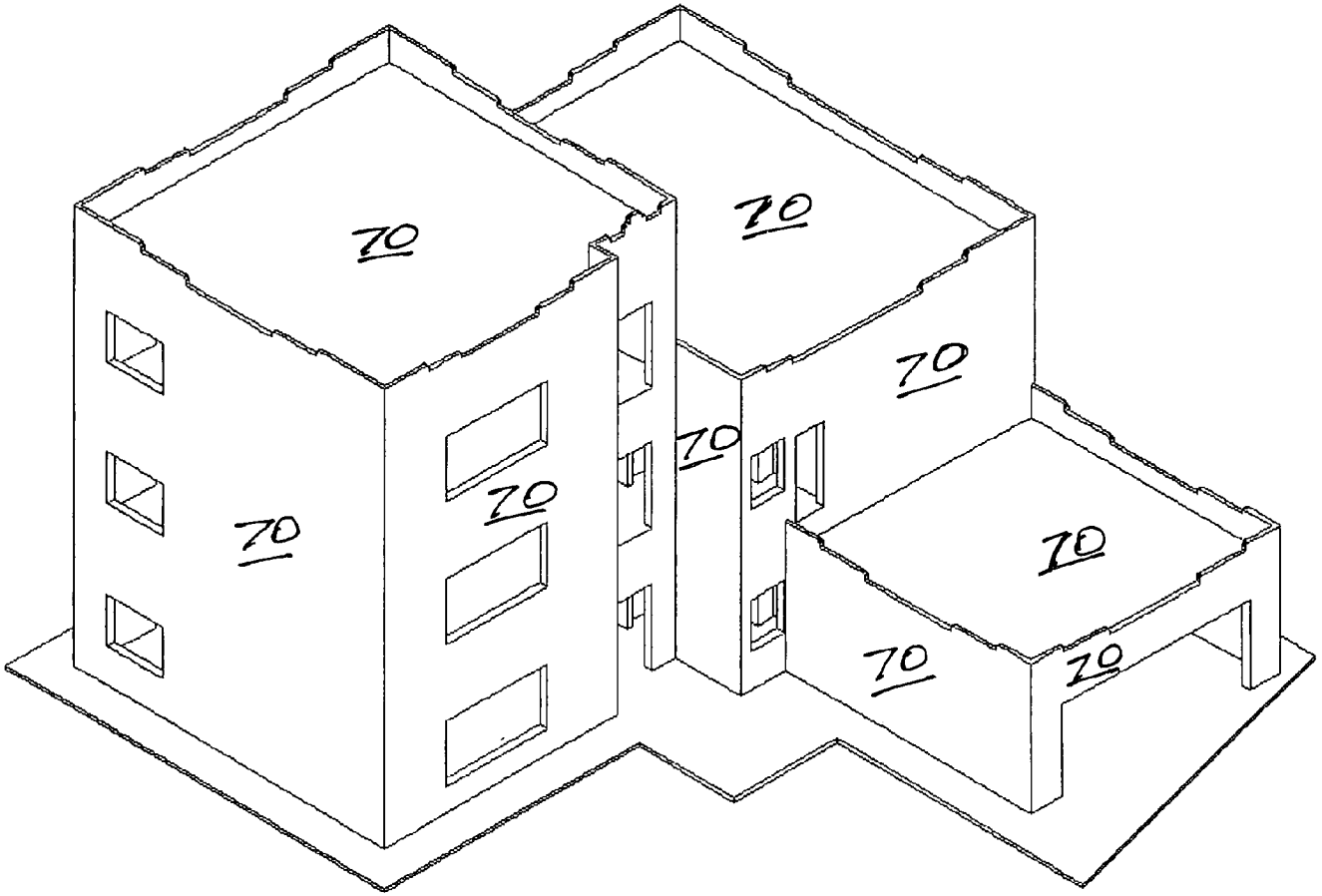

FIG. 40 shows the composite building with a finish coat 70.

Figure 41:
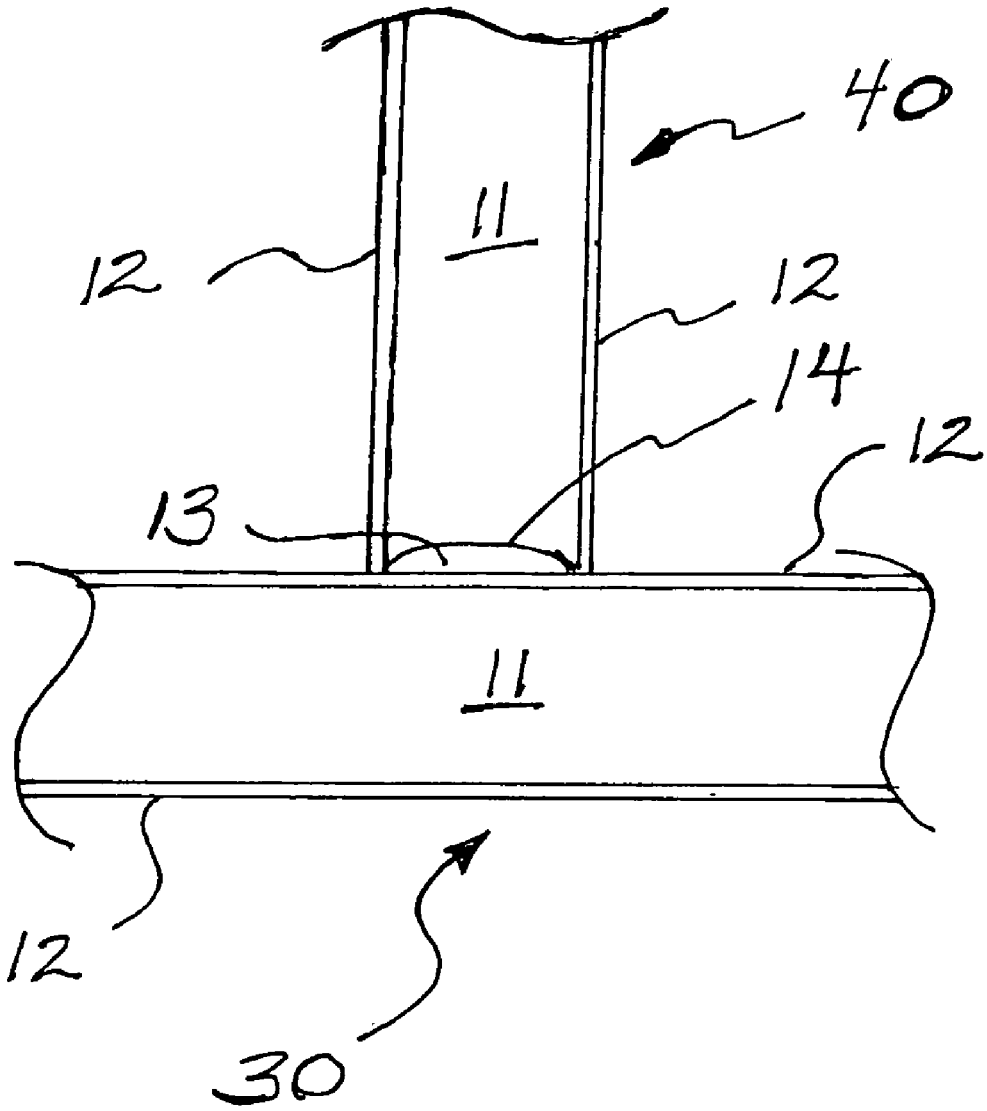
FIGS. 41 and 42 are top edge views.

FIG. 41 shows the connection/joint between an inner wall 40 and an outer wall 30. The pieces 10 that form the walls of the building are formed from plastic foam panels 11 having Fiber Reinforced Coatings (FRCs) 12 on major surfaces. The top, bottom and side edges are usually left uncoated by the FRC. Wall 40 has some of the foam removed on the edge that abuts and connects to wall 30. The cavity 13 is delineated by edge 14. The cavity 13 can be created by using a blow torch to melt the foam, then roughing up the surface of the foam with a tool such as a rasp and then power washing the surface to remove any debris.

A bonding agent is then added to the cavity, and wall 40 abutted to wall 30. A suitable bonding agent can be a FRC, such as Glass Fiber Reinforced Concrete (GFRC) which has a strength of 40 psi. Another suitable bonding agent can be PolyUrethane (PU) which has a strength of 5 psi. When using PU, the PU must be sealed from the elements. A sealant for the PU can be GFRC, an elastomer or other suitable sealant added to the joint on both sides.

More bonding agent can be added to the joint from the top or from holes that can be made in the joint.

All of the walls are braced or shored until the bonding agent sets which usually is 11 hours for the GFRC. In the case of GFRC, the thickness of the bonding agent/GFRC can be ¼-½ inch or more depending on the cavity size.

In the joint between the walls 30,40 and the slab 20 (not shown), a cavity 13 is created in the bottom edge of the wall, like that shown in FIG. 41. A bonding agent which can be FRC (GFRC) is spread on the slab, and the wall is lowered on to the slab over the bonding agent. The excess bonding agent is expelled from the cavity when the wall is lowered on to the slab.

Figure 42:
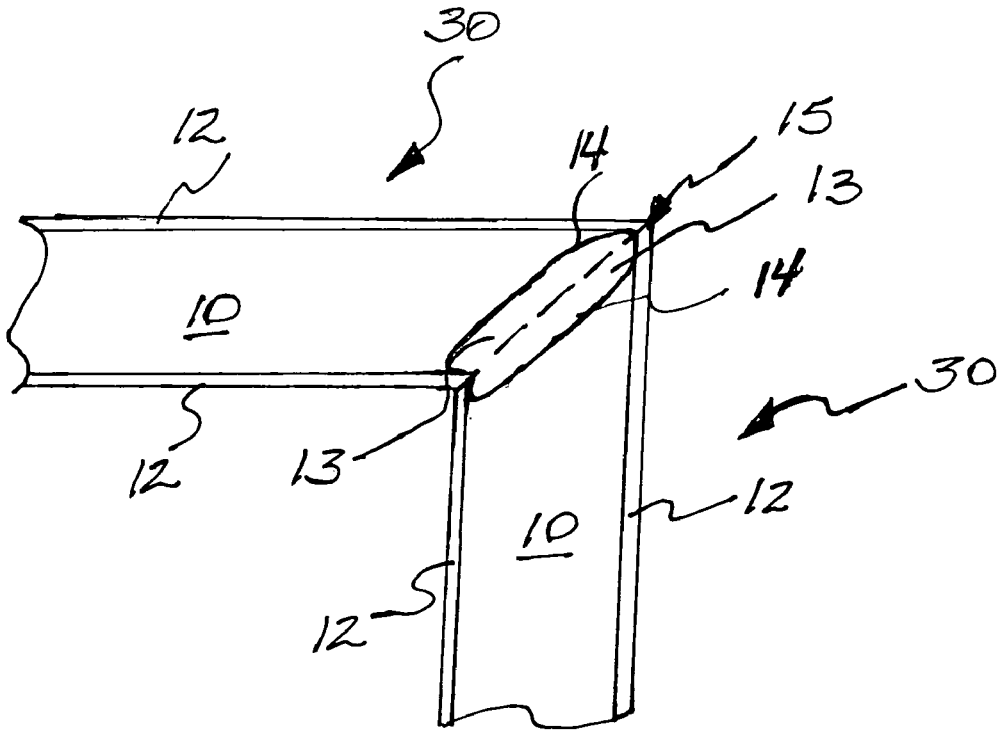

FIG. 42 shows a mitered joint between walls, one or both of the walls has a cavity 13 created in its abutting edge, and the bonding agent (GFRC) is added as explained in FIG. 41:

Various changes and modifications to the embodiments herein chosen for purposes of illustration will readily occur to those skilled in the art.

The FRC can be a Glass Fiber Reinforced Concrete (GFRC) or a Fiber Reinforced Polymer (FRP). The fibers can be plastic, glass, carbon, single-wall carbon nanotubes (SWNTs or Buckytubes), Aramid or other fibers. The Polymer can be Epoxies, Polyesters, Vinlyesters or other materials.

The coating also can be without fibers if the design loading is low enough. For the strongest structure, fibers should be added to the coating. The number of coats of the coating and the composition of those coats can be varied.

The bonding agent between the foam surfaces can be PolyUrethane (PU), GFRC or other material which will adhere to the surfaces to be bonded. GFRC can be used where the joint must have very high strength.

Bonding agents that bond foam to foam, foam to concrete and concrete to concrete can be structural or non-structural as certified by International Code Council (ICC). One structural bonding agent is Glass Fiber Reinforced Concrete (GFRC). A thickness of 0.25-0.50 inches is suitable.

A formula for GFRC is:

1 bag of cement (Portland Cement Type III)—94 pounds,

No. 30 silica sand—100 pounds, water and ice—25 pounds, polymer (Forton™ VF-774)—12 pounds, retarder (Daratard™ 17)—2-5 ounces, plasticizer (Daracem™ 19)—2-6 ounces, 0.5 inch glass fibers (Cem-FIL™ or Nippon AR™)—1.5 pounds and 1.5 inch glass fibers—1.5 pounds.

A lower strength bonding agent can be expansive plastic foams, such as Expansive PolyUrethane (EPU or PU), etc.

The type of plastic foam can be different from Expanded PolyStyrene (EPS). The EPS can have a density of 1.5 pounds per cu. ft. (nominal) which is actually 1.35 pounds per cu. ft. (actual). EPS was used because a Finite Element Analysis was done using EPS and GFRC. Suitable plastic foam could be PU, EPS, etc.

The specific materials used to build the structure may be varied, such as the type of plastic foam, the bonding agents, the coatings, etc.

I claim:

1. A method of constructing a composite building formed from a composite of a plastic foam core having opposing faces coated with a Fiber Reinforced Coating (FRC), comprising the following steps providing foam walls that have the desired dimensions for constructing the building, then coating the walls with a FRC, transporting the FRC coated walls to a building site, joining a first wall to a prepared portion of the site with a bonding agent, supporting the first wall during at least partial curing of the bonding agent, joining a second wall to the prepared portion of the site and the first wall with a bonding agent, supporting the second wall during at least partial curing of the bonding agent and repeating the steps until a building is constructed.

2. The method of claim 1 including, forming a window opening in a wall before transporting the wall to the building site.

3. The method of claim 1 including, forming a door opening in a wall before transporting the wall to the building site.

* * * * *